US008115414B2

(12) United States Patent
Zhao et al.

(10) Patent No.: US 8,115,414 B2
(45) Date of Patent: Feb. 14, 2012

(54) LED DRIVER WITH SEGMENTED DYNAMIC HEADROOM CONTROL

(75) Inventors: Bin Zhao, Irvine, CA (US); Jack W. Cornish, Foothill Ranch, CA (US); Brian B. Horng, Irvine, CA (US); Victor K. Lee, Irvine, CA (US); Andrew M. Kameya, Irvine, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 460 days.

(21) Appl. No.: 12/363,179

(22) Filed: Jan. 30, 2009

(65) Prior Publication Data

US 2009/0230874 A1 Sep. 17, 2009

Related U.S. Application Data

(60) Provisional application No. 61/036,053, filed on Mar. 12, 2008.

(51) Int. Cl.
*H05B 37/02* (2006.01)

(52) U.S. Cl. ..... 315/299; 315/185 S; 315/308; 315/312; 315/360

(58) Field of Classification Search ..... 315/185 R, 315/185 S, 209 R, 210, 224–226, 246, 247, 315/291, 294, 299, 302, 307, 308, 312, 324, 315/360

See application file for complete search history.

(56) References Cited

U.S. PATENT DOCUMENTS 3,973,197 A 8/1976 Meyer
4,162,444 A 7/1979 Rodgers
4,615,029 A 9/1986 Hu et al.
4,649,432 A 3/1987 Watanabe et al.
4,686,640 A 8/1987 Simison
5,025,176 A 6/1991 Takeno
5,038,055 A 8/1991 Kinoshita
5,455,868 A 10/1995 Sergent et al.
5,508,909 A 4/1996 Maxwell et al.
5,635,864 A 6/1997 Jones
5,723,950 A 3/1998 Wei et al.

(Continued)

FOREIGN PATENT DOCUMENTS

JP 2003332624 A 11/2003

(Continued)

OTHER PUBLICATIONS

Notice of Allowance mailed Apr. 7, 2011 for U.S. Appl. No. 12/326,963, 20 pages.

(Continued)

*Primary Examiner* — Thuy Vinh Tran

(57) ABSTRACT

Techniques for dynamic headroom control in a light emitting diode (LED) system are disclosed. An output voltage is provided to drive a plurality of LED strings. A feedback controller monitors the tail voltages of the LED strings to identify the minimum tail voltage and adjusts the output voltage based on the lowest tail voltage. The LED strings grouped into subsets and the feedback controller is segmented such that, for a certain duration, a minimum tail voltage is determined for each subset. The minimum tail voltages of the subsets are used to determine the overall minimum tail voltage of the plurality of LED strings for the certain duration so as to control the output voltage in the following duration. The segments of the feedback controller can be implemented in separate integrated circuit (IC) packages, thereby facilitating adaptation to different numbers of LED strings by integrating the corresponding number of IC packages.

20 Claims, 11 Drawing Sheets

U.S. PATENT DOCUMENTS

| | | | | |
|---|---|---|---|---|
| 6,002,356 | A | 12/1999 | Cooper | |
| 6,281,822 | B1 | 8/2001 | Park | |
| 6,373,423 | B1 | 4/2002 | Knudsen | |
| 6,636,104 | B2 * | 10/2003 | Henry | 327/536 |
| 6,822,403 | B2 | 11/2004 | Horiuchi et al. | |
| 6,864,641 | B2 | 3/2005 | Dygert | |
| 6,943,500 | B2 | 9/2005 | LeChevalier | |
| 7,211,958 | B2 | 5/2007 | Maurer et | |
| 7,262,724 | B2 | 8/2007 | Hughes et al. | |
| 7,307,614 | B2 | 12/2007 | Vinn | |
| 7,315,095 | B2 | 1/2008 | Kagemoto et al. | |
| 7,391,280 | B2 | 6/2008 | Hsu | |
| 7,436,378 | B2 | 10/2008 | Ito et al. | |
| 7,459,959 | B2 * | 12/2008 | Rader et al. | 327/536 |
| 7,511,545 | B1 | 3/2009 | Kesler | |
| 7,598,686 | B2 | 10/2009 | Lys et al. | |
| 7,696,915 | B2 | 4/2010 | Chmelar et al. | |
| 7,777,704 | B2 | 8/2010 | S et al. | |
| 7,973,495 | B2 * | 7/2011 | Ion et al. | 315/297 |
| 2004/0208011 | A1 | 10/2004 | Horiuchi et al. | |
| 2004/0233144 | A1 | 11/2004 | Rader et al. | |
| 2006/0164162 | A1 | 7/2006 | Dauphinee et al. | |
| 2006/0186830 | A1 | 8/2006 | Shami et al. | |
| 2006/0261895 | A1 | 11/2006 | Kocaman et al. | |
| 2007/0080911 | A1 | 4/2007 | Liu et al. | |
| 2007/0253330 | A1 | 11/2007 | Tochio et al. | |
| 2008/0054815 | A1 | 3/2008 | Kotikalapoodi | |
| 2008/0297067 | A1 | 12/2008 | Wang et al. | |
| 2009/0108775 | A1 | 4/2009 | Sandner et al. | |
| 2009/0128045 | A1 | 5/2009 | Szczeszynski et al. | |
| 2009/0187925 | A1 | 7/2009 | Hu et al. | |
| 2009/0230891 | A1 | 9/2009 | Zhao et al. | |
| 2009/0273288 | A1 | 11/2009 | Zhao et al. | |
| 2009/0315481 | A1 | 12/2009 | Zhao | |
| 2010/0013395 | A1 | 1/2010 | Archibald et al. | |
| 2010/0013412 | A1 | 1/2010 | Archibald et al. | |
| 2010/0026203 | A1 | 2/2010 | Zhao et al. | |
| 2010/0085295 | A1 | 4/2010 | Zhao et al. | |
| 2010/0156315 | A1 | 6/2010 | Zhao et al. | |

FOREIGN PATENT DOCUMENTS

| | | | |
|---|---|---|---|
| JP | 2005116199 | A | 4/2005 |
| KR | 1020070082004 | A | 8/2007 |
| WO | 2005022596 | A2 | 3/2005 |

OTHER PUBLICATIONS

PCT Application No. PCT/US2010/028289; Search Report and Written Opinion dated Dec. 15, 2010.
Non-Final Office Action mailed Apr. 19, 2011 for U.S. Appl. No. 12/363,294, 19 pages.
Non-Final Office Action mailed Apr. 19, 2011 for U.S. Appl. No. 12/363,607, 17 pages.
Office Action—TS48276ZC NFOA Feb. 4, 2010, 11 pages.
Office Action—TS48276ZC NOA Jun. 2, 2010, 7 pages.
Office Action—TS48276ZC NOA Jul. 9, 2010, 12 pages.
International App. No. PCT/US2009/065913, Search Report mailed Jul. 7, 2010, 4 pages.
Mc Nerney, Tim, "Constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.
Maxim: "Application Note 810, Understanding Flash ADCs," Oct. 2, 2001, 8 pages.
National Semiconductor Data Sheet: "LM3432/LM3432B 6-Channel Current Regulator for LED Backlight Application," May 22, 2008, pp. 1-18.
U.S. Appl. No. 12/537,443, filed Aug. 7, 2009, entitled Pulse Width Modulation Frequency Conversion.
U.S. Appl. No. 12/703,239, filed Feb. 10, 2010, entitled "Pulse Width Modulation With Effective High Duty Resolution".
U.S. Appl. No. 12/537,692, filed Aug. 7, 2009, entitled "Phase-Shifted Pulse Width Modulation Signal Generation".
U.S. Appl. No. 12/625,818, filed Nov. 25, 2009, entitled "Synchronized Phase-Shifted Pulse Width Modulation Signal Generation".
U.S. Appl. No. 12/703,249, filed Feb. 10, 2010, entitled "Duty Transition Control in Pulse Width Modulation Signaling".
Luke Huiyong Chung, Electronic Products: "Driver ICs for LED BLUs," May 1, 2008, 3 pages.
Akira Takahashi, Electronic Products: "Methods and features of LED drivers," Mar. 2008, 3 pages.
U.S. Appl. No. 12/340,985, filed Dec. 22, 2008, entitled "LED Driver With Feedback Calibration".
U.S. Appl. No. 12/326,963, filed Dec. 3, 2008, entitled "LED Driver With Precharge and Track/Hold".
U.S. Appl. No. 12/367,672, filed Feb. 9, 2009, entitled "Configuration for Dynamic Power Control in LED Displays".
U.S. Appl. No. 12/424,326, filed Apr. 15, 2009, entitled "Peak Detection With Digital Conversion".
U.S. Appl. No. 12/504,841, filed Jul. 17, 2009, entitled "Analog-To-Digital Converter With Non-Uniform Accuracy".
U.S. Appl. No. 12/690,972, filed Jan. 21, 2010, entitled "Serial Cascade of Minimum Tail Voltages of Subsets of LED Strings for Dynamic Power Contrl in LED Displays".
U.S. Appl. No. 12/363,607, filed Jan. 30, 2009, entitled "LED Driver With Dynamic Headroom Control".
International Application No. PCT/US2009/035284, Search Report and Written Opinion, Oct. 28, 2009, 11 pages.
Texas Instruments Publication, "Interleaved Dual PWM Controller with Programmable Max Duty Cycle," SLUS544A, (UCC28220, UCC28221) Sep. 2003, pp. 1-28.
Notice of Allowance mailed Jun. 21, 2011 for U.S. Appl. No. 12/340,985, 27 pages.
Non-Final Office Action mailed May 4, 2011 for U.S. Appl. No. 12/367,672, 26 pages.
Notice of Allowance mailed Jul. 19, 2011 for U.S. Appl. No. 12/424,326, 27 pages.
Notice of Allowance mailed Aug. 1, 2011 for U.S. Appl. No. 12/363,294, 11 pages.
Notice of Allowance mailed Aug. 11, 2011 for U.S. Appl. No. 12/363,607, 9 pages.
Notice of Allowance mailed Sep. 27, 2011 for U.S. Appl. No. 12/504,335, 35 pages.
Final Office Action mailed Oct. 20, 2011 for U.S. Appl. No. 12/367,672, 24 pages.

* cited by examiner

LED DRIVER WITH SEGMENTED DYNAMIC HEADROOM CONTROL

CROSS-REFERENCE TO RELATED APPLICATION

The present application claims priority to U.S. Provisional Patent Application No. 61/036,053, filed Mar. 12, 2008 and having common inventorship, the entirety of which is incorporated by reference herein. The present application also claims priority to U.S. patent application Ser. No. 12/056,237 filed Mar. 26, 2008, which is now U.S. Pat. No. 7,825,610, the entirety of which is incorporated by reference herein.

FIELD OF THE DISCLOSURE

The present disclosure relates generally to light emitting diodes (LEDs) and more particularly to LED drivers.

BACKGROUND

Light emitting diodes (LEDs) often are used as light sources in liquid crystal displays (LCDs) and other displays. The LEDs often are arranged in parallel "strings" driven by a shared voltage source, each LED string having a plurality of LEDs connected in series. To provide consistent light output between the LED strings, each LED string typically is driven at a regulated current that is substantially equal among all of the LED strings.

Although driven by currents of equal magnitude, there often is considerable variation in the bias voltages needed to drive each LED string due to variations in the static forward-voltage drops of individual LEDs of the LED strings resulting from process variations in the fabrication and manufacturing of the LEDs. Dynamic variations due to changes in temperature when the LEDs are enabled and disabled also can contribute to the variation in bias voltages needed to drive the LED strings with a fixed current. In view of this variation, conventional LED drivers typically provide a fixed voltage that is sufficiently higher than an expected worst-case bias drop so as to ensure proper operation of each LED string. However, as the power consumed by the LED driver and the LED strings is a product of the output voltage of the LED driver and the sum of the currents of the individual LED strings, the use of an excessively high output voltage by the LED driver unnecessarily increases power consumption by the LED driver. Accordingly, an improved technique for driving LED strings would be advantageous.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-15 illustrate example techniques for dynamic power management in a light emitting diode (LED) system having a plurality of LED strings. A voltage source provides an output voltage to drive the LED strings. A feedback controller of an LED driver monitors the tail voltages of the LED strings to identify the minimum, or lowest, tail voltage and adjusts the output voltage of the voltage source based on the lowest tail voltage. In at least one embodiment, the feedback controller adjusts the output voltage so as to maintain the lowest tail voltage at or near a predetermined threshold voltage so as to ensure that the output voltage is sufficient to properly drive each active LED string with a regulated current in view of pulse width modulation (PWM) timing requirements without excessive power consumption. Further, as described below with reference to FIGS. 13-15, the plurality of LED strings can be grouped into subsets and the feedback controller can be segmented such that, for a certain duration, a minimum tail voltage is determined for each subset, and then the minimum tail voltages of the subsets are used to determine the overall minimum tail voltage of the plurality of LED strings for the certain duration so as to control the output voltage provided to the plurality of LED strings in the following duration. In this way, the segments of the feedback controller can be implemented in separate integrated circuit (IC) packages, thereby allowing the LED system to adapt to different numbers of LED strings by integrating the corresponding number of IC packages.

The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string. The term "tail voltage," as used herein, refers the voltage at the tail end of a LED string or representation thereof (e.g., a voltage-divided representation, an amplified representation, etc.). The term "subset of LED strings" refers to one or more LED strings.

Figure 1:
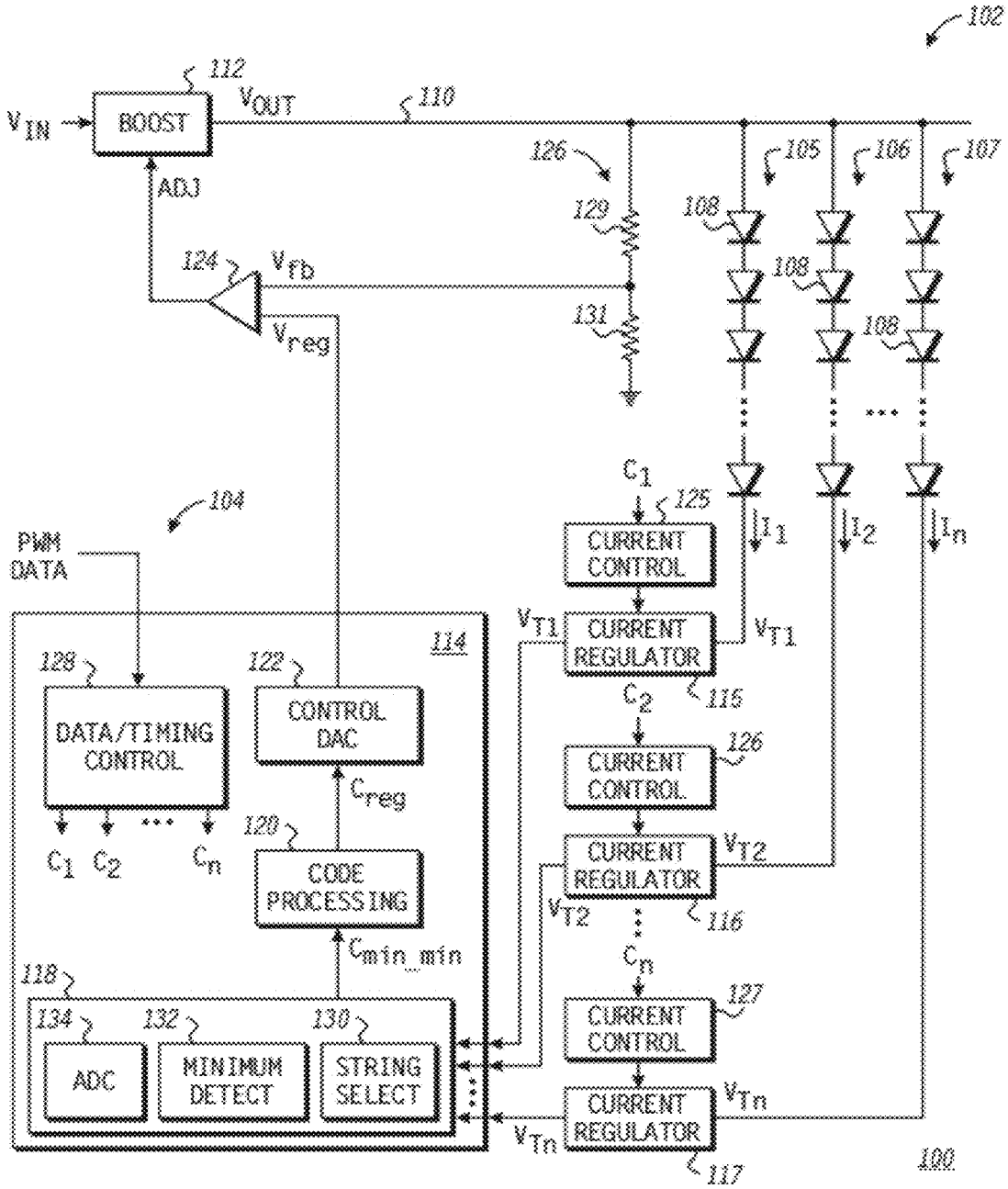
FIG. 1 is a diagram illustrating a light emitting diode (LED) system having dynamic power management in accordance with at least one embodiment of the present disclosure.

FIG. 1 illustrates a LED system 100 having dynamic power management in accordance with at least one embodiment of the present disclosure. In the depicted example, the LED system 100 includes a LED panel 102, a LED driver 104, and a voltage source 112 for providing an output voltage VOUT to drive the LED panel 102. The LED panel 102 includes a plurality of LED strings (e.g., LED strings 105, 106, and 107). Each LED string includes one or more LEDs 108 connected in series. The LEDs 108 can include, for example, white LEDs, red, green, blue (RGB) LEDs, organic LEDs (OLEDs), etc. Each LED string is driven by the adjustable voltage $V_{OUT}$ received at the head end of the LED string via a voltage bus 110 (e.g., a conductive trace, wire, etc.). In the embodiment of FIG. 1, the voltage source 112 is implemented as a boost converter configured to drive the output voltage $V_{OUT}$ using an input voltage $V_{IN}$.

The LED driver 104 includes a feedback controller 114 configured to control the voltage source 112 based on the tail voltages at the tail ends of the LED strings 105-107. As described in greater detail below, the LED driver 104, in one embodiment, receives pulse width modulation (PWM) data representative of which of the LED strings 105-107 are to be activated and at what times during a corresponding PWM cycle, and the LED driver 104 is configured to either collectively or individually activate the LED strings 105-107 at the appropriate times in their respective PWM cycles based on the PWM data.

The feedback controller 114, in one embodiment, includes a plurality of current regulators (e.g., current regulators 115, 116, and 117), a code generation module 118, a code processing module 120, a control digital-to-analog converter (DAC) 122, an error amplifier (or comparator) 124, and a data/timing control module 128 (illustrated in FIG. 1 as part of the feedback controller 114).

In the example of FIG. 1, the current regulator 115 is configured to maintain the current $I_1$ flowing through the LED string 105 at or near a fixed current (e.g., 30 mA) when active. Likewise, the current regulators 116 and 117 are configured to maintain the current $I_2$ flowing through the LED string 106 when active and the current $I_n$ flowing through the LED string 107 when active, respectively, at or near the fixed current. The current control modules 125, 126, and 127 are configured to activate or deactivate the LED strings 105, 106, and 107, respectively, via the corresponding current regulators.

Typically, a current regulator, such as current regulators 115-117, operates more optimally when the input of the current regulator is a non-zero voltage so as to accommodate the variation in the input voltage that often results from the current regulation process of the current regulator. This buffering voltage often is referred to as the "headroom" of the current regulator. As the current regulators 115-117 are connected to the tail ends of the LED strings 105-107, respectively, the tail voltages of the LED strings 105-107 represent the amounts of headroom available at the corresponding current regulators 115-117. However, headroom in excess of that necessary for current regulation purposes results in unnecessary power consumption by the current regulator. Accordingly, as described in greater detail herein, the LED system 100 employs techniques to provide dynamic headroom control so as to maintain the minimum tail voltage of the active LED strings at or near a predetermined threshold voltage, thus maintaining the lowest headroom of the current regulators 105-107 at or near the predetermined threshold voltage. The threshold voltage can represent a determined balance between the need for sufficient headroom to permit proper current regulation by the current regulators 105-107 and the advantage of reduced power consumption by reducing the excess headroom at the current regulators 105-107.

The data/timing control module 128 receives the PWM data and is configured to provide control signals to the other components of the LED driver 104 based on the timing and activation information represented by the PWM data. To illustrate, the data/timing control module 128 provides control signals $C_1$, $C_2$, and $C_n$ to the current control modules 125, 126, and 127, respectively, to control which of the LED strings 105-107 are active during corresponding portions of their respective PWM cycles. The data/timing control module 128 also provides control signals to the code generation module 118, the code processing module 120, and the control DAC 122 so as to control the operation and timing of these components. The data/timing control module 128 can be implemented as hardware, software executed by one or more processors, or a combination thereof. To illustrate, the data/timing control module 128 can be implemented as a logic-based hardware state machine.

The code generation module 118 includes a plurality of tail inputs coupled to the tail ends of the LED strings 105-107 to receive the tail voltages $V_{T1}$, $V_{T2}$, and $V_{Tn}$ of the LED strings 105, 106, and 107, respectively, and an output to provide a code value $C_{min_min}$. In at least one embodiment, the code generation module 118 is configured to identify or detect the minimum, or lowest, tail voltage of the LED strings 105-107 that occurs over a PWM cycle or other specified duration and generate the digital code value $C_{min_min}$ based on the identified minimum tail voltage. In the disclosure provided herein, the following nomenclature is used: the minimum of a particular measured characteristic over a PWM cycle or other specified duration is identified with the subscript "min_min", thereby indicating it is the minimum over a specified time span; whereas the minimum of a particular measured characteristic at a given point in time or sample point is denoted with the subscript "min." To illustrate, the minimum tail voltage of the LED strings 105-107 at any given point in time or sample point is identified as $V_{Tmin}$, whereas the minimum tail voltage of the LED strings 105-107 for a given PWM cycle (having one or more sample points) is identified as $V_{Tmin_min}$. Similarly, the minimum code value determined at a given point in time or sample point is identified as $C_{min}$, whereas the minimum code value for a given PWM cycle (having one or more sample points) is identified as $C_{min_min}$.

The code generation module 118 can include one or more of a string select module 130, a minimum detect module 132, and an analog-to-digital converter (ADC) 134. As described in greater detail below with reference to FIGS. 4, 5, 8 and 9, the string select module 130 is configured to output the minimum tail voltage $V_{Tmin}$ of the LED strings 105-107 (which can vary over the PWM cycle), the ADC 134 is configured to convert the magnitude of the minimum tail voltage $V_{Tmin}$ output by the string select module 130 to a corresponding code value $C_{min}$ for each of a sequence of conversion points in the PWM cycle, the minimum detect module 132 is configured as a digital component to detect the minimum code value $C_{min}$ from the plurality of code values $C_{min}$ generated over the PWM cycle as the minimum code value $C_{min_min}$ for the PWM cycle. Alternately, as described in greater detail below with reference to FIGS. 6 and 7, the minimum detect module 132 is configured as an analog component to determine the minimum tail voltage $V_{Tmin_min}$ for the PWM cycle from the potentially varying magnitude of the voltage $V_{Tmin}$ output by the string select module 130 over the PWM cycle, and the ADC 134 is configured to perform a single conversion of the voltage $V_{Tmin_min}$ to the minimum code value $C_{min_min}$ for the PWM cycle. As another embodiment, as described in greater detail below with reference to FIGS. 10 and 11, the string select module 130 is omitted and the ADC 134 can be configured as multiple ADCs. Each ADC is configured to repeatedly convert the tail voltage of a corresponding one of the LED strings 105-107 into a series of code values $C_i$ (for a corresponding LED string i) having magnitudes representative of the magnitude of the tail voltage at the time of the conversion. In this instance, the minimum detect module 132 is configured as a digital component to determine the minimum of the code values $C_i$ generated from all of the ADCs to identify the minimum code value $C_{min_min}$ over the PWM cycle.

The code processing module 120 includes an input to receive the code value $C_{min_min}$ and an output to provide a code value $C_{reg}$ based on the code value $C_{min_min}$ and either a previous value for $C_{reg}$ from a previous PWM cycle or an initialization value. As the code value $C_{min_min}$ represents the minimum tail voltage $V_{Tmin_min}$ that occurred during the PWM cycle for all of the LED strings 105-107, the code processing module 120, in one embodiment, compares the code value $C_{min_min}$ to a threshold code value, $C_{thresh}$, and generates a code value $C_{reg}$ based on the comparison. The code processing module 120 can be implemented as hardware, software executed by one or more processors, or a combination thereof. To illustrate, the code processing module 120 can be implemented as a logic-based hardware state machine, software executed by a processor, and the like. Example implementations of the code generation module 118 and the code processing module 120 are described in greater detail with reference to FIGS. 4-11.

In certain instances, none of the LED strings 105-107 may be enabled for a given PWM cycle. Thus, to prevent an erroneous adjustment of the output voltage $V_{OUT}$ when all LED strings are disabled, in one embodiment the data/timing control module 128 signals the code processing module 120 to suppress any updated code value $C_{reg}$ determined during a PWM cycle in which all LED strings are disabled, and instead use the code value $C_{reg}$ from the previous PWM cycle.

The control DAC 122 includes an input to receive the code value $C_{reg}$ and an output to provide a regulation voltage $V_{reg}$ representative of the code value $C_{reg}$. The regulation voltage $V_{reg}$ is provided to the error amplifier 124. The error amplifier 124 also receives a feedback voltage $V_{fb}$ representative of the output voltage $V_{OUT}$. In the illustrated embodiment, a voltage divider 126 implemented by resistors 129 and 131 is used to generate the voltage $V_{fb}$ from the output voltage $V_{OUT}$. The error amplifier 124 compares the voltage $V_{fb}$ and the voltage $V_{reg}$ and configures a signal ADJ based on this comparison. The voltage source 112 receives the signal ADJ and adjusts the output voltage $V_{OUT}$ based on the magnitude of the signal ADJ.

As similarly described above, there may be considerable variation between the voltage drops across each of the LED strings 105-107 due to static variations in forward-voltage biases of the LEDs 108 of each LED string and dynamic variations due to the on/off cycling of the LEDs 108. Thus, there may be significant variance in the bias voltages needed to properly operate the LED strings 105-107. However, rather than drive a fixed output voltage $V_{OUT}$ that is substantially higher than what is needed for the smallest voltage drop as this is handled in conventional LED drivers, the LED driver 104 illustrated in FIG. 1 utilizes a feedback mechanism that permits the output voltage $V_{OUT}$ to be adjusted so as to reduce or minimize the power consumption of the LED driver 104 in the presence of variances in voltage drop across the LED strings 105-107, as described below with reference to the methods 200 and 300 of FIG. 2 and FIG. 3, respectively. For ease of discussion, the feedback duration of this mechanism is described in the context of a PWM cycle-by-PWM cycle basis for adjusting the output voltage $V_{OUT}$. However, any of a variety of durations may be used for this feedback mechanism without departing from the scope of the present disclosure. To illustrate, the feedback duration could encompass a portion of a PWM cycle, multiple PWM cycles, a certain number of clock cycles, a duration between interrupts, a duration related to video display such as video frame, and the like.

Figure 2:
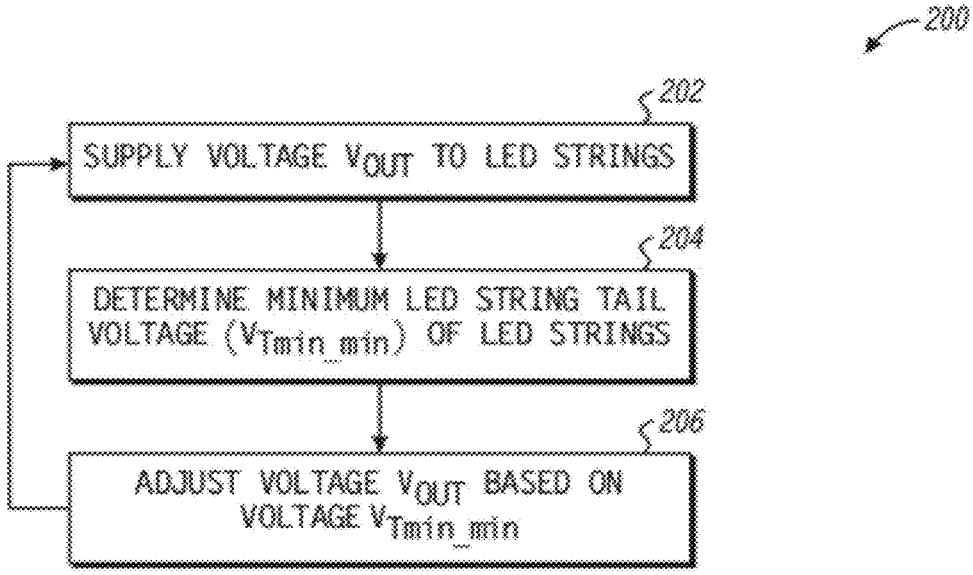
FIG. 2 is a flow diagram illustrating a method of operation of the LED system of FIG. 1 in accordance with at least one embodiment of the present disclosure.

FIG. 2 illustrates an example method 200 of operation of the LED system 100 in accordance with at least one embodiment of the present disclosure. At block 202, the voltage source 112 provides an initial output voltage $V_{OUT}$. As the PWM data for a given PWM cycle is received, the data/timing control module 128 configures the control signals $C_1$, $C_2$, and $C_n$ so as to selectively activate the LED strings 105-107 at the appropriate times of their respective PWM cycles. Over the course of the PWM cycle, the code generation module 118 determines the minimum detected tail voltage ($V_{Tmin_min}$) for the LED tails 105-107 for the PWM cycle at block 204. At block 206, the feedback controller 114 configures the signal ADJ based on the voltage $V_{Tmin_min}$ to adjust the output voltage $V_{OUT}$, which in turn adjusts the tail voltages of the LED strings 105-107 so that the minimum tail voltage $V_{Tmin}$ of the LED strings 105-107 is closer to a predetermined threshold voltage. The process of blocks 202-206 can be repeated for the next PWM cycle, and so forth.

As a non-zero tail voltage for a LED string indicates that more power is being used to drive the LED string than is absolutely necessary, it typically is advantageous for power consumption purposes for the feedback controller 114 to manipulate the voltage source 112 to adjust the output voltage $V_{OUT}$ until the minimum tail voltage $V_{Tmin_min}$ would be approximately zero, thereby eliminating nearly all excess power consumption that can be eliminated without disturbing the proper operation of the LED strings. Accordingly, in one embodiment, the feedback controller 114 configures the signal ADJ so as to reduce the output voltage $V_{OUT}$ by an amount expected to cause the minimum tail voltage $V_{Tmin_min}$ of the LED strings 105-107 to be at or near zero volts.

However, while being advantageous from a power consumption standpoint, having a near-zero tail voltage (headroom voltage) on a LED string introduces potential problems. As one issue, the current regulators 115-117 may need non-zero tail voltages to operate properly. Further, it will be appreciated that a near-zero tail voltage provides little or no margin for spurious increases in the bias voltage needed to drive the LED string resulting from self-heating or other dynamic influences on the LEDs 108 of the LED strings 105-107. Accordingly, in at least one embodiment, the feedback controller 114 can achieve a suitable compromise between reduction of power consumption and the response time of the LED driver 104 by adjusting the output voltage $V_{OUT}$ so that the expected minimum tail voltage of the LED strings 105-107 or the expected minimum headroom voltage for the current regulators 115-117 is maintained at or near a non-zero threshold voltage $V_{thresh}$ that represents an acceptable compromise between LED current regulation, PWM response time and reduced power consumption. The threshold voltage $V_{thresh}$ can be implemented as, for example, a voltage between 0.1 V and 1 V (e.g., 0.5 V).

Figure 3:
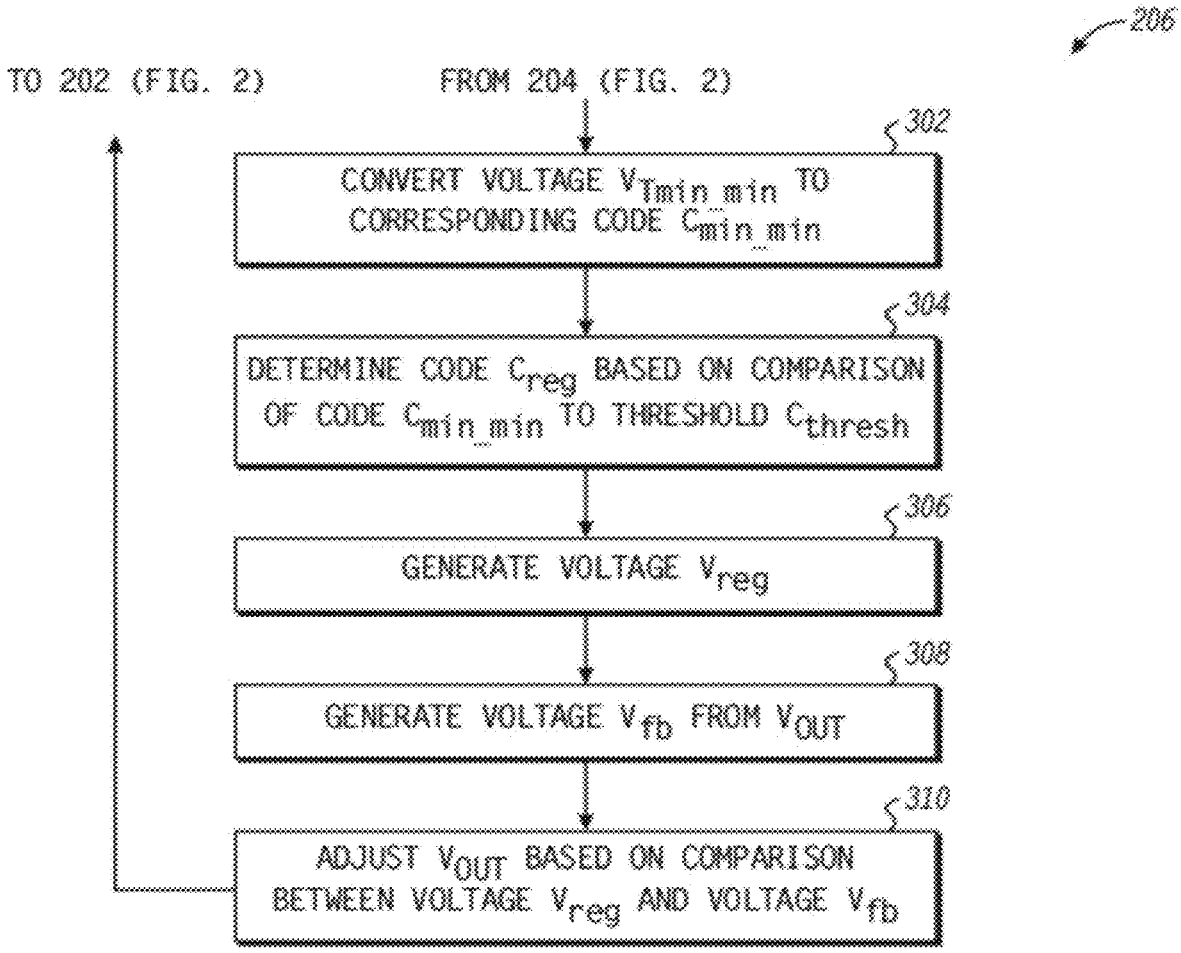
FIG. 3 is a flow diagram illustrating the method of FIG. 2 in greater detail in accordance with at least one embodiment of the present disclosure.

FIG. 3 illustrates a particular implementation of the process represented by block 206 of the method 200 of FIG. 2 in accordance with at least one embodiment of the present disclosure. As described above, at block 204 (FIG. 2) of the method 200, the code generation module 118 monitors the tail voltages $V_{T1}$, $V_{T2}$, and $V_{Tn}$ of the LED tails 105-107 to identify the minimum detected tail voltage $V_{Tmin_min}$ for the PWM cycle. At block 302, the code generation module 118 converts the voltage $V_{Tmin_min}$ to a corresponding digital code value $C_{min_min}$. Thus, the code value $C_{min_min}$ is a digital value representing the minimum tail voltage $V_{Tmin_min}$ detected during the PWM cycle. As described in greater detail herein, the detection of the minimum tail voltage $V_{Tmin_min}$ can be determined in the analog domain and then converted to a digital value, or the detection of the minimum tail voltage $V_{Tmin_min}$ can be determined in the digital domain based on the identification of the minimum code value $C_{min_min}$ from a plurality of code values $C_{min}$ representing the minimum tail voltage $V_{Tmin}$ at various points over the PWM cycle.

At block 304, the code processing module 120 compares the code value $C_{min_min}$ with a code value $C_{thresh}$ to determine the relationship of the minimum tail voltage $V_{Tmin_min}$ (represented by the code value $C_{min_min}$) to the threshold voltage $V_{thresh}$ (represented by the code value $C_{thresh}$). As described above, the feedback controller 114 is configured to control the voltage source 112 so as to maintain the minimum tail voltage of the LED strings 105-107 at or near a threshold voltage $V_{thresh}$ during the corresponding PWM cycle. The voltage $V_{thresh}$ can be at or near zero volts to maximize the reduction in power consumption or it can be a non-zero voltage (e.g., 0.5 V) so as to comply with PWM performance requirements and current regulation requirements while still reducing power consumption.

The code processing module 120 generates a code value $C_{reg}$ based on the relationship of the minimum tail voltage $V_{Tmin_min}$ to the threshold voltage $V_{thresh}$ revealed by the comparison of the code value $C_{min_min}$ to the code value $C_{thresh}$. As described herein, the value of the code value $C_{reg}$ affects the resulting change in the output voltage $V_{OUT}$. Thus, when the code value $C_{min_min}$ is greater than the code value $C_{thresh}$, a value for $C_{reg}$ is generated so as to reduce the output voltage $V_{OUT}$, which in turn is expected to reduce the minimum tail voltage $V_{Tmin}$ closer to the threshold voltage $V_{thresh}$. To illustrate, the code processing module 120 compares the code value $C_{min_min}$ to the code value $C_{thresh}$. If the code value $C_{min_min}$ is less than the code value $C_{thresh}$, an updated value for $C_{reg}$ is generated so as to increase the output voltage $V_{OUT}$, which in turn is expected to increase the minimum tail voltage $V_{Tmin_min}$ closer to the threshold voltage $V_{thresh}$. Conversely, if the code value $C_{min_min}$ is greater than the code value $C_{thresh}$, an updated value for $C_{reg}$ is generated so as to decrease the output voltage $V_{OUT}$, which in turn is expected to decrease the minimum tail voltage $V_{Tmin\ min}$ closer to the threshold voltage $V_{thresh}$. To illustrate, the updated value for $C_{reg}$ can be set to $$C_{reg}(\text{updated}) = C_{reg}(\text{current}) + offset1 \quad \text{EQ. 1}$$

$$offset1 = \frac{R_{f2}}{R_{f1} + R_{f2}} \times \frac{(C_{thresh} - C_{min_min})}{\text{Gain_ADC} \times \text{Gain_DAC}} \quad \text{EQ. 2}$$

whereby $R_{f1}$ and $R_{f2}$ represent the resistances of the resistor 129 and the resistor 131, respectively, of the voltage divider 126 and Gain_ADC represents the gain of the ADC (in units code per volt) and Gain DAC represents the gain of the control DAC 122 (in unit of volts per code). Depending on the relationship between the voltage $V_{Tmin_min}$ and the voltage $V_{thresh}$ (or the code value $C_{min_min}$ and the code value $C_{thresh}$), the offset1 value can be either positive or negative.

Alternately, when the code $C_{min_min}$ indicates that the minimum tail voltage $V_{Tmin_min}$ is at or near zero volts (e.g., $C_{min_min}$=0) the value for updated $C_{reg}$ can be set to $$C_{reg}(\text{updated}) = C_{reg}(\text{current}) + \text{offset2} \quad \text{EQ. 3}$$

whereby offset2 corresponds to a predetermined voltage increase in the output voltage $V_{OUT}$ (e.g., 1 V increase) so as to affect a greater increase in the minimum tail voltage $V_{Tmin_min}$.

At block 306, the control DAC 122 converts the updated code value $C_{reg}$ to its corresponding updated regulation voltage $V_{reg}$. At block 308, the feedback voltage $V_{fb}$ is obtained from the voltage divider 126. At block 310, error amplifier 124 compares the voltage $V_{reg}$ and the voltage $V_{fb}$ and configures the signal ADJ so as to direct the voltage source 112 to increase or decrease the output voltage $V_{OUT}$ depending on the result of the comparison as described above. The process of blocks 302-310 can be repeated for the next PWM cycle, and so forth.

Figure 4:
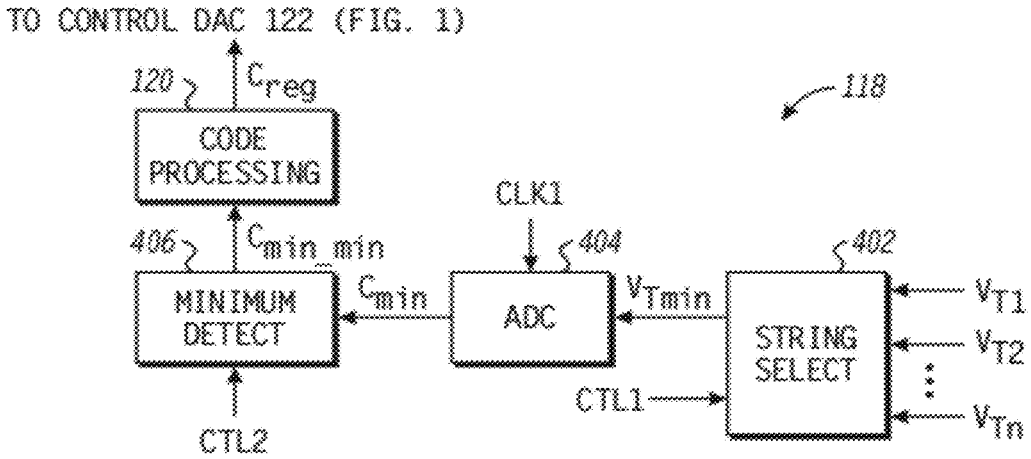
FIG. 4 is a diagram illustrating an example implementation of a feedback controller of the LED system of FIG. 1 in accordance with at least one embodiment of the present disclosure.

FIG. 4 illustrates a particular implementation of the code generation module 118 and the code processing module 120 of the LED driver 104 of FIG. 1 in accordance with at least one embodiment of the present disclosure. In the illustrated embodiment, the code generation module 118 includes an analog string select module 402 (corresponding to the string select module 130, FIG. 1), an analog-to-digital converter (ADC) 404 (corresponding to the ADC 134, FIG. 1), and a digital minimum detect module 406 (corresponding to the minimum detect module 132, FIG. 1). The analog string select module 402 includes a plurality of inputs coupled to the tail ends of the LED strings 105-107 (FIG. 1) so as to receive the tail voltages $V_{T1}$, $V_{T2}$, and $V_{Tn}$. In one embodiment, the analog string select module 402 is configured to provide the voltage $V_{Tmin}$ that is equal to or representative of the lowest tail voltage of the active LED strings at the corresponding point in time of the PWM cycle. That is, rather than supplying a single voltage value at the conclusion of a PWM cycle, the voltage $V_{Tmin}$ output by the analog string select module 402 varies throughout the PWM cycle as the minimum tail voltage of the LED strings changes at various points in time of the PWM cycle.

The analog string select module 402 can be implemented in any of a variety of manners. For example, the analog string select module 402 can be implemented as a plurality of semiconductor p-n junction diodes, each diode coupled in a reverse-polarity configuration between a corresponding tail voltage input and the output of the analog string select module 402 such that the output of the analog string select module 402 is always equal to the minimum tail voltage $V_{Tmin}$ where the offset from voltage drop of the diodes (e.g., 0.5 V or 0.7 V) can be compensated for using any of a variety of techniques.

The ADC 404 has an input coupled to the output of the analog string select module 402, an input to receive a clock signal CLK1, and an output to provide a sequence of code values $C_{min}$ over the course of the PWM cycle based on the magnitude of the minimum tail voltage $V_{Tmin}$ at respective points in time of the PWM cycle (as clocked by the clock signal CLK1). The number of code values $C_{min}$ generated over the course of the PWM cycle depends on the frequency of the clock signal CLK1. To illustrate, if the clock signal CLK1 has a frequency of 1000*CLK_PWM (where CLK_PWM is the frequency of the PWM cycle) and can convert the magnitude of the voltage $V_{Tmin}$ to a corresponding code value $C_{min}$ at a rate of one conversion per clock cycle, the ADC 404 can produce 1000 code values $C_{min}$ over the course of the PWM cycle.

The digital minimum detect module 406 receives the sequence of code values $C_{min}$ generated over the course of the PWM cycle by the ADC 404 and determines the minimum, or lowest, of these code values for the PWM cycle. To illustrate, the digital minimum detect module 406 can include, for example, a buffer, a comparator, and control logic configured to overwrite a code value $C_{min}$ stored in the buffer with an incoming code value $C_{min}$ if the incoming code value $C_{min}$ is less than the one in the buffer. The digital minimum detect module 406 provides the minimum code value $C_{min}$ of the series of code values $C_{min}$ for the PWM cycle as the code value $C_{min_min}$ to the code processing module 120. The code processing module 120 compares the code value $C_{min_min}$ to the predetermined code value $C_{thresh}$ and generates an updated code value $C_{reg}$ based on the comparison as described in greater detail above with reference to block 304 of FIG. 3.

Figure 5:
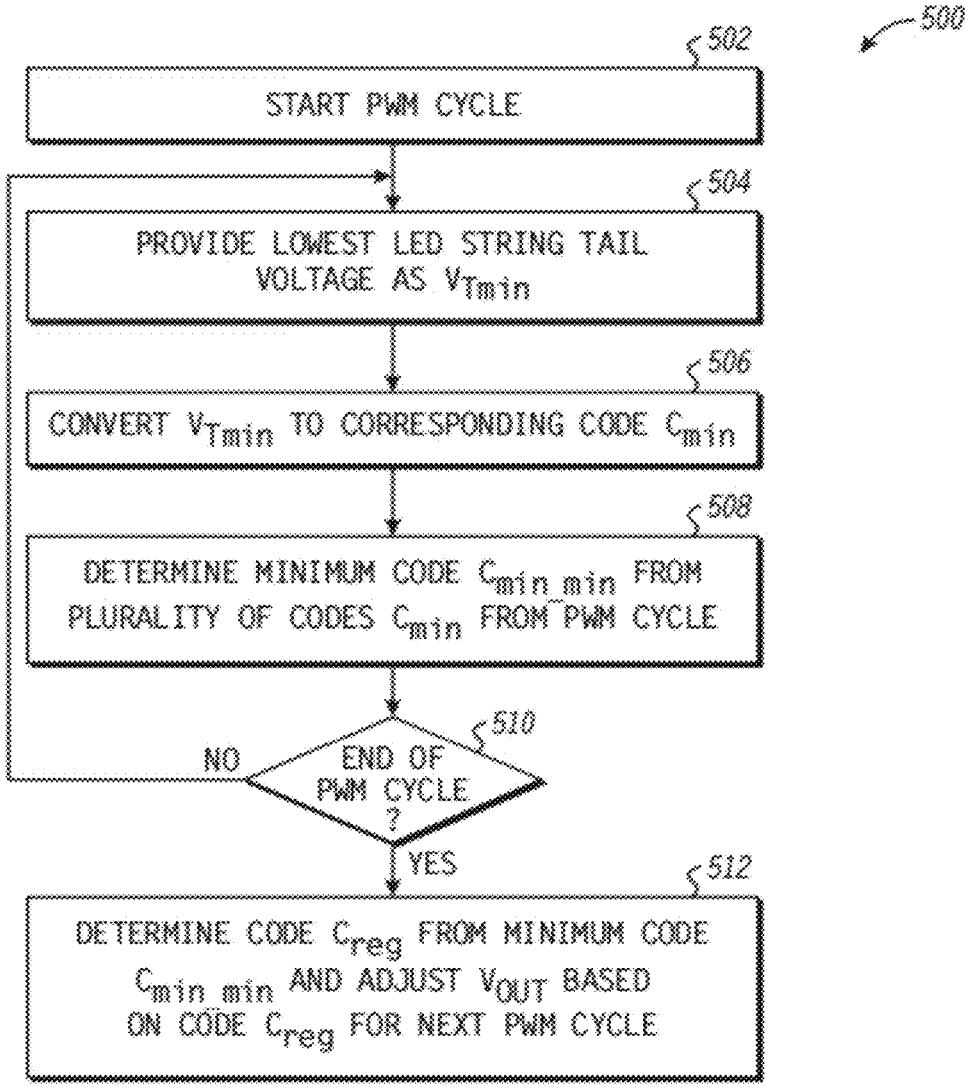
FIG. 5 is a flow diagram illustrating a method of operation of the example implementation of FIG. 4 in accordance with at least one embodiment of the present disclosure.

FIG. 5 illustrates an example method 500 of operation of the implementation of the LED system 100 illustrated in FIGS. 1 and 4 in accordance with at least one embodiment of the present disclosure. At block 502, a PWM cycle starts, as indicated by the received PWM data (FIG. 1). At block 504, the analog string select module 402 provides the minimum tail voltage of the LED strings at a point in time of the PWM cycle as the voltage $V_{Tmin}$ for that point in time. At block 506, the ADC 404 converts the voltage $V_{Tmin}$ to a corresponding code value $C_{min}$ and provides it to the digital minimum detect 406 for consideration as the minimum code value $C_{min_min}$ for the PWM cycle thus far at block 508. At block 510, the data/timing control module 128 determines whether the end of the PWM cycle has been reached. If not, the process of blocks 504-508 is repeated to generate another code value $C_{min}$. Otherwise, if the PWM cycle has ended, the minimum code value $C_{min}$ of the plurality of code values $C_{min}$ generated during the PWM cycle is provided as the code value $C_{min_min}$ by the digital minimum detect module 406. In an alternate embodiment, the plurality of code values $C_{min}$ generated during the PWM cycle are buffered and then the minimum value $C_{min_min}$ is determined at the end of the PWM cycle from the plurality of buffered code values $C_{min}$. At block 512 the code processing module 120 uses the minimum code value $C_{min_min}$ to generate an updated code value $C_{reg}$ based on a comparison of the code value $C_{min_min}$ to the predetermined code value $C_{thresh}$. The control DAC 122 uses the updated code value $C_{reg}$ to generate the corresponding voltage $V_{reg}$, which is used by the error amplifier 124 along with the voltage $V_{fb}$ to adjust the output voltage $V_{OUT}$ as described above.

Figure 6:
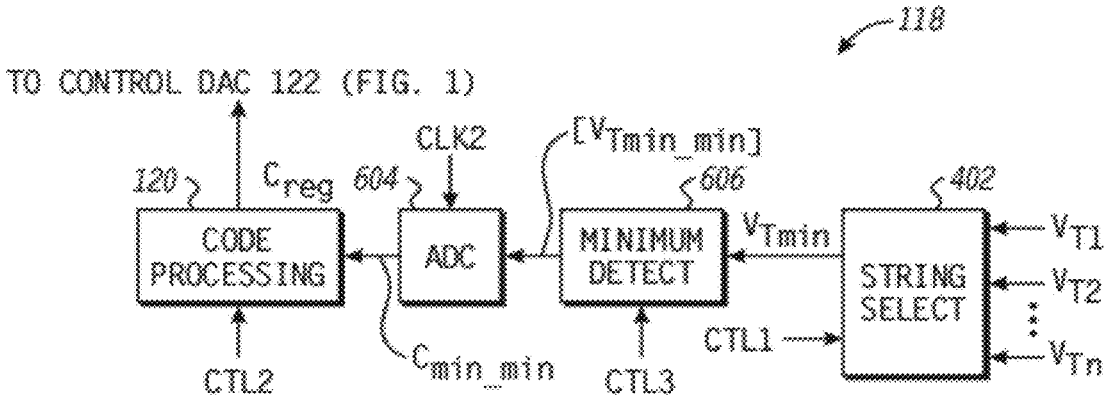
FIG. 6 is a diagram illustrating another example implementation of the feedback controller of the LED system of FIG. 1 in accordance with at least one embodiment of the present disclosure.

FIG. 6 illustrates another example implementation of the code generation module 118 and the code processing module 120 of the LED driver 104 of FIG. 1 in accordance with at least one embodiment of the present disclosure. In the illustrated embodiment, the code generation module 118 includes the analog string select module 402 as described above, an analog minimum detect module 606 (corresponding to the minimum detect module 132, FIG. 1), and an ADC 604 (corresponding to the ADC 134, FIG. 1). As described above, the analog string select module 402 continuously selects and outputs the minimum tail voltage of the LED strings 105-107 at any given time as the voltage $V_{Tmin}$ for that point in time. The analog minimum detect module 606 includes an input coupled to the output of the analog string select module 402, an input to receive a control signal CTL3 from the data/timing control module 128 (FIG. 1), where the control signal CTL3 signals the start and end of each PWM cycle. In at least one embodiment, the analog minimum detect module 606 detects the minimum voltage of the output of the analog string select module 402 over the course of a PWM cycle and outputs the minimum detected voltage as the minimum tail voltage $V_{Tmin_min}$.

The analog minimum detect module 606 can be implemented in any of a variety of manners. To illustrate, in one embodiment, the analog minimum detect module 606 can be implemented as a negative peak voltage detector that is accessed and then reset at the end of each PWM cycle. Alternately, the analog minimum detect module 606 can be implemented as a set of sample-and-hold circuits, a comparator, and control logic. One of the sample-and-hold circuits is used to sample and hold the voltage $V_{Tmin}$ and the comparator is used to compare the sampled voltage with a sampled voltage held in a second sample-and-hold circuit. If the voltage of the first sample-and-hold circuit is lower, the control logic switches to using the second sample-and-hold circuit for sampling the voltage $V_{Tmin}$ for comparison with the voltage held in the first sample-and-hold circuit, and so on.

The ADC 604 includes an input to receive the minimum tail voltage $V_{Tmin_min}$ for the corresponding PWM cycle and an input to receive a clock signal CLK2. The ADC 604 is configured to generate the code value $C_{min_min}$ representing the minimum tail voltage $V_{Tmin_min}$ and provide the code value $C_{min_min}$ to the code processing module 120, whereby it is compared with the predetermined code value $C_{thresh}$ to generate the appropriate code value $C_{reg}$ as described above.

Figure 7:
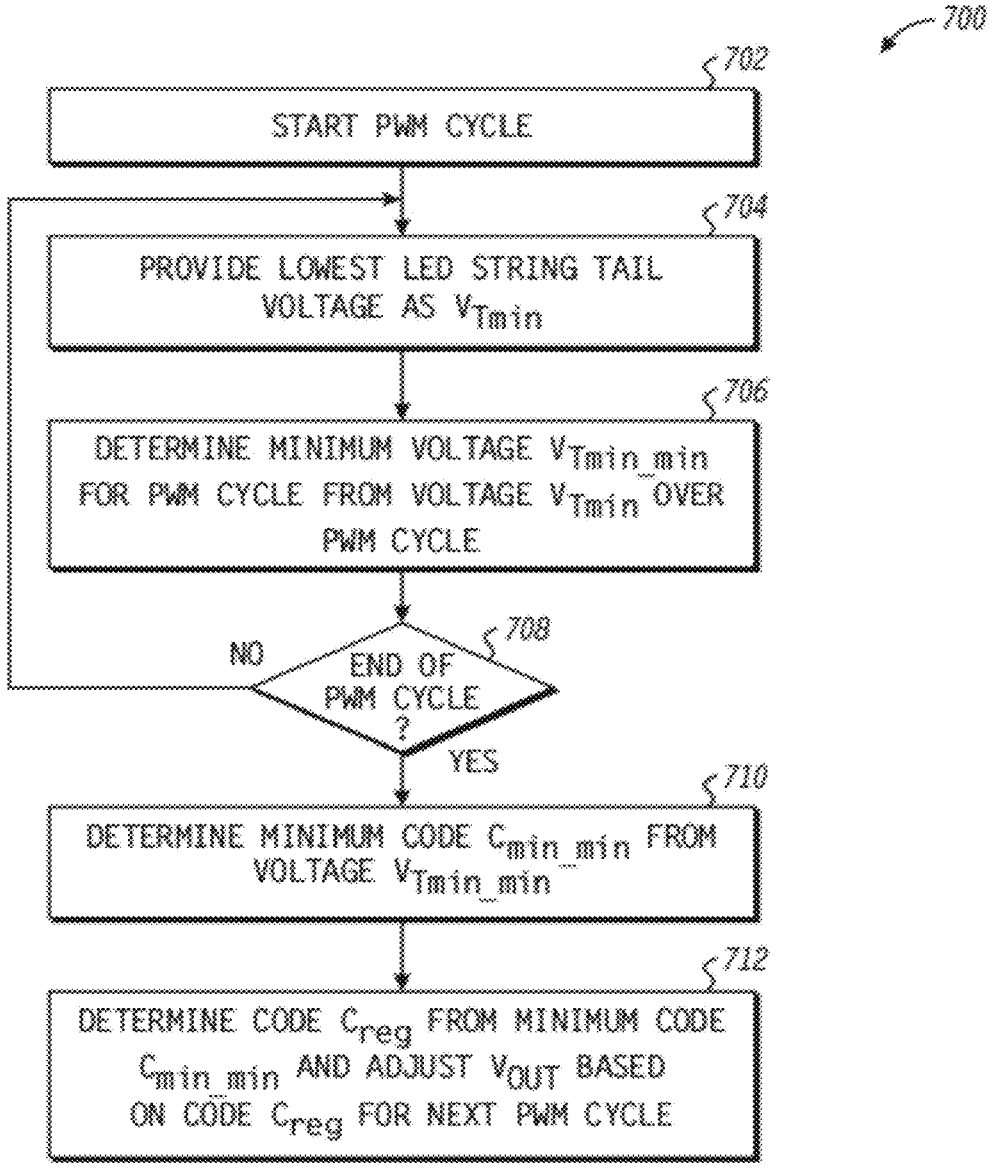
FIG. 7 is a flow diagram illustrating a method of operation of the example implementation of FIG. 6 in accordance with at least one embodiment of the present disclosure.

FIG. 7 illustrates an example method 700 of operation of the implementation of the LED system 100 illustrated in FIGS. 1 and 6 in accordance with at least one embodiment of the present disclosure. At block 702, a PWM cycle starts, as indicated by the received PWM data (FIG. 1). At block 704, the analog string select module 402 provides the lowest tail voltage of the active LED strings at a given point in time of the PWM cycle as the voltage $V_{Tmin}$ for that point in time. At block 706, the minimum magnitude of the voltage $V_{Tmin}$ detected by the analog minimum detect module 606 is identified as the minimum tail voltage $V_{Tmin_min}$ for the PWM cycle thus far. At block 708, the data/timing control module 128 determines whether the end of the PWM cycle has been reached. If the PWM cycle has ended, the ADC 604 converts the minimum tail voltage $V_{Tmin_min}$ to the corresponding code value $C_{min_min}$. At block 712, the code processing module 120 converts the code value $C_{min_min}$ to an updated code value $C_{reg}$ based on a comparison of the code value $C_{min_min}$ to the predetermined code value $C_{thresh}$. The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

In the implementation of FIGS. 4 and 5, the voltage $V_{Tmin}$ output by the analog string select module 402 was converted into a sequence of code values $C_{min}$ based on the clock signal CLK1 and the sequence of code values $C_{min}$ was analyzed to determine the minimum code value of the sequence, and thus to determine the code value $C_{min_min}$ representative of the minimum tail voltage $V_{Tmin_min}$ occurring over a PWM cycle.

Such an implementation requires an ADC 404 capable of operating with a high-frequency clock CLK1. The implementation of FIGS. 6 and 7 illustrates an alternate with relaxed ADC and clock frequency requirements because the minimum tail voltage $V_{Tmin_min}$ over a PWM cycle is determined in the analog domain and thus only a single analog-to-digital conversion is required from the ADC 604 per PWM cycle, at the cost of adding the analog minimum detect module 606.

Figure 8:
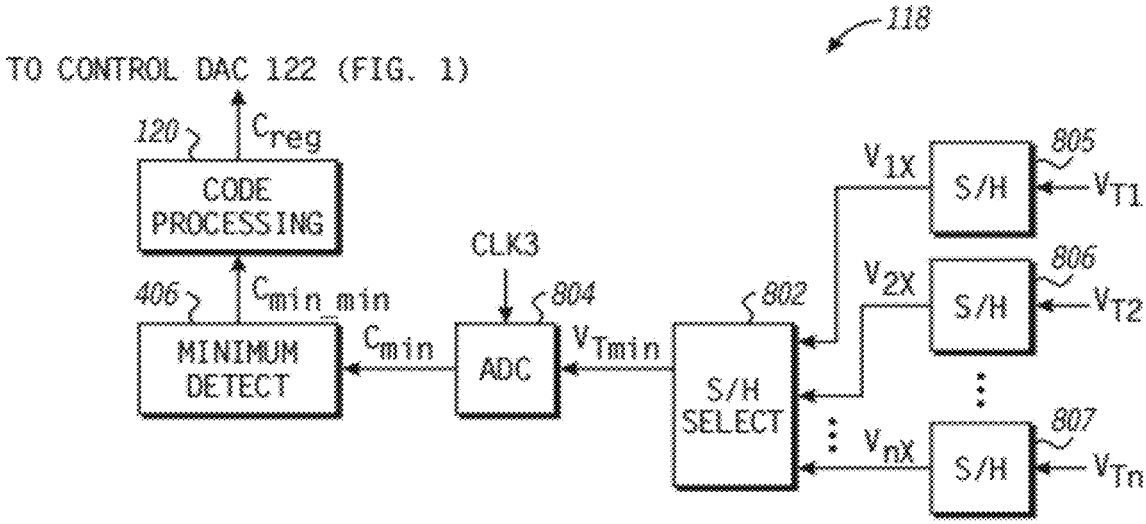
FIG. 8 is a diagram illustrating another example implementation of the feedback controller of the LED system of FIG. 1 in accordance with at least one embodiment of the present disclosure.

FIG. 8 illustrates yet another example implementation of the code generation module 118 and the code processing module 120 of the LED driver 104 of FIG. 1 in accordance with at least one embodiment of the present disclosure. In the illustrated embodiment, the code generation module 118 includes a plurality of sample-and-hold (S/H) circuits, such as S/H circuits 805, 806, and 807, a S/H select module 802 (corresponding to the string select module 130, FIG. 1), an ADC 804 (corresponding to the ADC 134, FIG. 1), and the digital minimum detect module 406 (described above).

Each of the S/H circuits 805-807 includes an input coupled to the tail end of a respective one of the LED strings 105-107 (FIG. 1) to receive the tail voltage of the LED string and an output to provide a sampled tail voltage of the respective LED string. In FIG. 8, the sampled voltages output by the S/H circuits 805-807 are identified as voltages $V_{1X}$, $V_{2X}$, and $V_{nX}$, respectively. In at least one embodiment, a control signal for a corresponding S/H circuit is enabled, thereby enabling sampling of the corresponding tail voltage, when the corresponding LED string is activated by a PWM pulse.

The S/H select module 802 includes a plurality of inputs to receive the sampled voltages $V_{1X}$, $V_{2X}$, and $V_{nX}$ and is configured to select the minimum, or lowest, of the sampled voltages $V_{1X}$, $V_{2X}$, and $V_{nX}$ at any given sample period for output as the voltage level of the voltage $V_{Tmin}$ for the sample point. The S/H select module 802 can be configured in a manner similar to the analog string select module 402 of FIGS. 4 and 6. The ADC 804 includes an input to receive the voltage $V_{Tmin}$ and an input to receive a clock signal CLK3. As similarly described above with respect to the ADC 404 of FIG. 4, the ADC 804 is configured to output a sequence of code values $C_{min}$ from the magnitude of the voltage $V_{Tmin}$ using the clock signal CLK3.

As described above, the digital minimum detect module 406 receives the stream of code values $C_{min}$ for a PWM cycle, determines the minimum code value of the stream, and provides the minimum code value as code value $C_{min_min}$ to the code processing module 120. The determination of the minimum code value $C_{min_min}$ can be updated as the PWM cycle progresses, or the stream of code values $C_{min}$ for the PWM cycle can be buffered and the minimum code value $C_{min_min}$ determined at the end of the PWM cycle from the buffered stream of code values $C_{min}$. The code processing module then compares the code value $C_{min_min}$ to the predetermined code value $C_{thresh}$ for the purpose of updating the code value $C_{reg}$.

Figure 9:
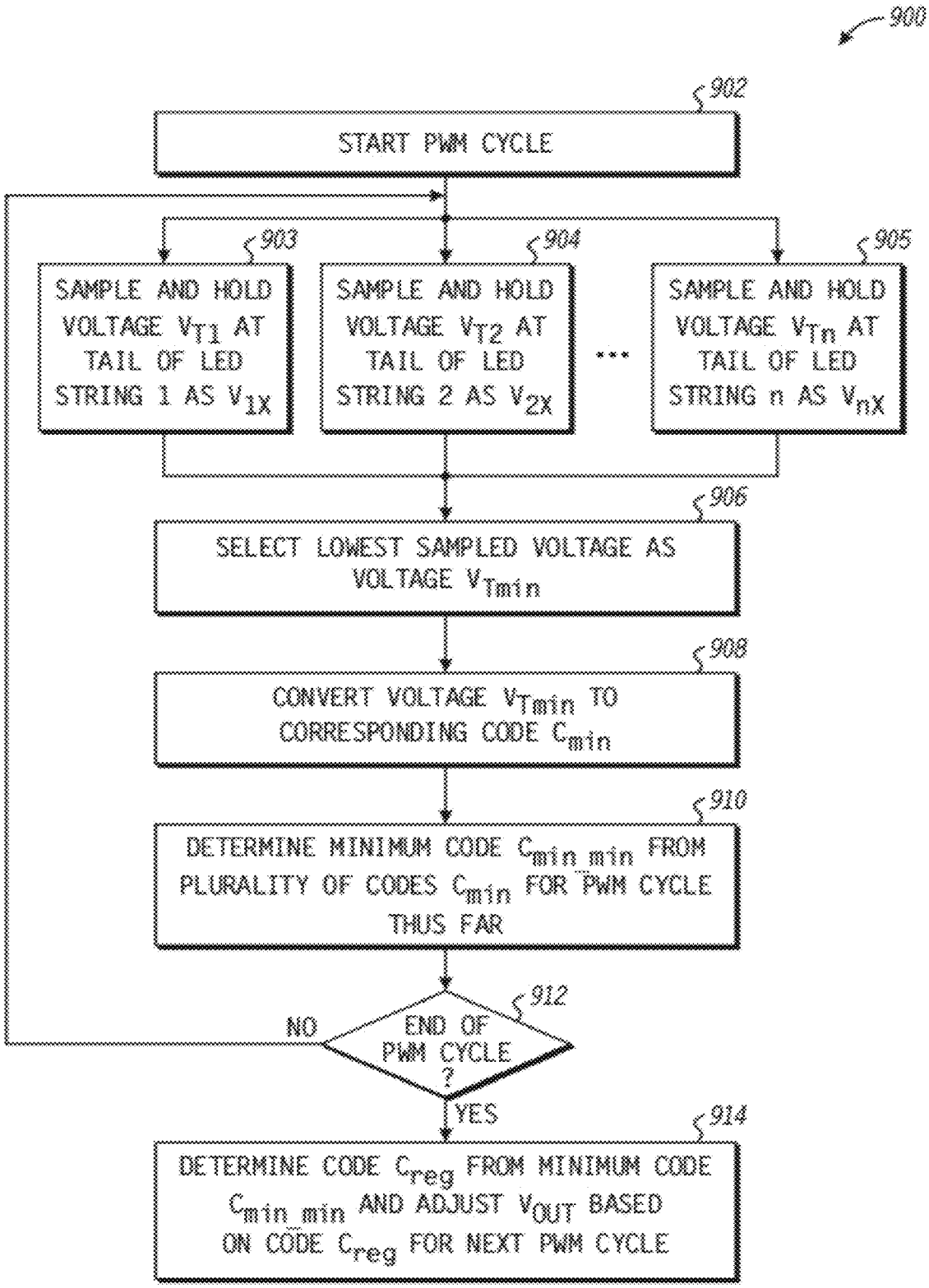
FIG. 9 is a flow diagram illustrating a method of operation of the example implementation of FIG. 8 in accordance with at least one embodiment of the present disclosure.

FIG. 9 illustrates an example method 900 of operation of the implementation of the LED system 100 illustrated in FIGS. 1 and 8 in accordance with at least one embodiment of the present disclosure. At block 902, a PWM cycle starts, as indicated by the received PWM data (FIG. 1). At block 903, the S/H circuit 805 samples and holds the voltage level of the tail end of the LED string 105 as the voltage $V_{1X}$ when the LED string 105 (e.g., when activated by a PWM pulse). Likewise, at block 904 the S/H circuit 806 samples and holds the voltage level of the tail end of the LED string 106 as the voltage $V_{2X}$ when the LED string 106 is activated by a PWM pulse, and at block 905 the S/H circuit 807 samples and holds the voltage level of the tail end of the LED string 107 as the voltage $V_{nx}$ when the LED string 107 is activated by a PWM pulse.

At block 906, the S/H select module 802 selects the minimum of the sampled voltages $V_{1X}$, $V_{2X}$, and $V_{nX}$ for output as the voltage $V_{Tmin}$. At block 908, the ADC 804 converts the magnitude of the voltage $V_{Tmin}$ at the corresponding sample point to the corresponding code value $C_{min}$ and provides the code value $C_{min}$ to the digital minimum detect module 406. At block 910, the digital minimum detect module 406 determines the minimum code value of the plurality of code values $C_{min}$ generated during the PWM cycle thus far as the minimum code value $C_{min_min}$. At block 912, the data/timing control module 128 determines whether the end of the PWM cycle has been reached. If not, the process of blocks 903, 904, 905, 906, 908, and 910 is repeated to generate another code value $C_{min}$ and update the minimum code value $C_{min_min}$ as necessary. Otherwise, if the PWM cycle has ended, at block 914, the code processing module 120 converts the code value $C_{min_min}$ to an updated code value $C_{reg}$ based on a comparison of the code value $C_{min_min}$ to the predetermined code value $C_{thresh}$. The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

Figure 10:
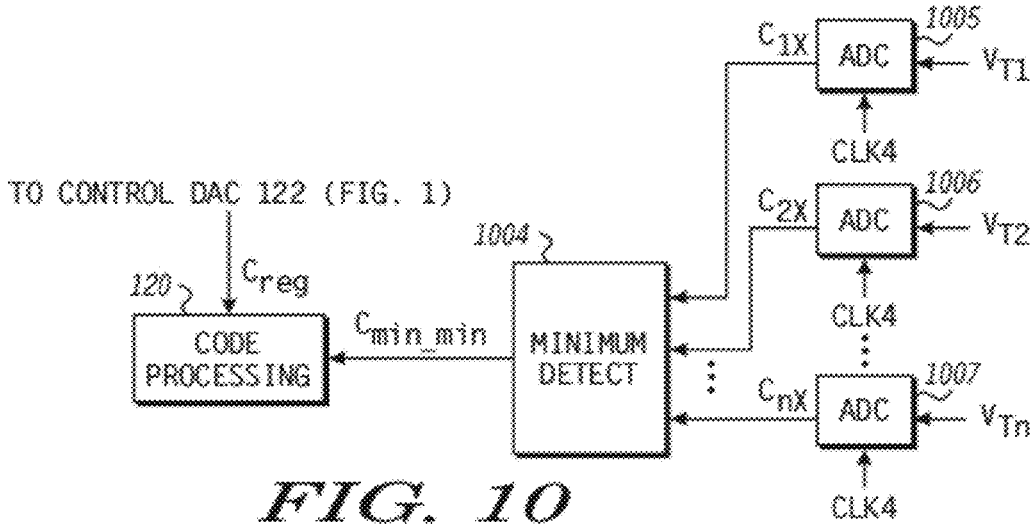
FIG. 10 is a diagram illustrating another example implementation of the feedback controller of the LED system of FIG. 1 in accordance with at least one embodiment of the present disclosure.

FIG. 10 illustrates another example implementation of the code generation module 118 and the code processing module 120 of the LED driver 104 of FIG. 1 in accordance with at least one embodiment of the present disclosure. In the illustrated embodiment, the code generation module 118 includes a plurality of ADCs, such as ADC 1005, ADC 1006, and ADC 1007 (corresponding to the ADC 134, FIG. 1) and a digital minimum detect module 1004 (corresponding to both the string select module 130 and the minimum detect module 132, FIG. 1).

Each of the ADCs 1005-1007 includes an input coupled to the tail end of a respective one of the LED strings 105-107 (FIG. 1) to receive the tail voltage of the LED string, an input to receive a clock signal CLK4, and an output to provide a stream of code values generated from the input tail voltage. In FIG. 10, the code values output by the ADCs 1005-1007 are identified as code values $C_{1X}$, $C_{2X}$, and $C_{nX}$, respectively.

The digital minimum detect module 1004 includes an input for each of the stream of code values output by the ADCs 1005-1007 and is configured to determine the minimum, or lowest, code value from all of the streams of code values for a PWM cycle. In one embodiment, the minimum code value for each LED string for the PWM cycle is determined and then the minimum code value $C_{min_min}$ is determined from the minimum code value for each LED string. In another embodiment, the minimum code value of each LED string is determined at each sample point (e.g., the minimum of $C_{1X}$, $C_{2X}$, and $C_{nX}$ at the sample point). The code processing module 120 then compares the code value $C_{min_min}$ to the predetermined code value $C_{thresh}$ for the purpose of updating the code value $C_{reg}$.

Figure 11:
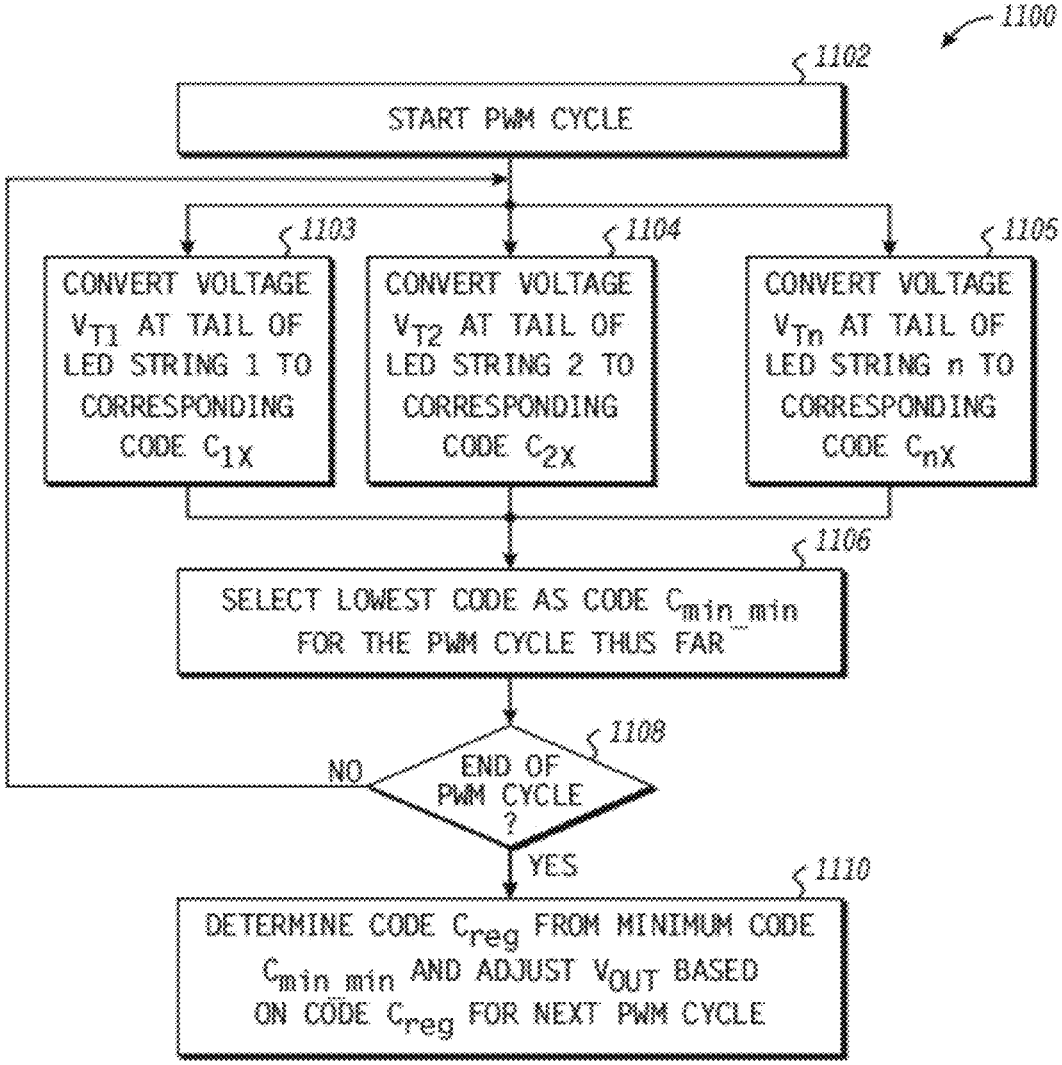
FIG. 11 is a flow diagram illustrating a method of operation of the example implementation of FIG. 10 in accordance with at least one embodiment of the present disclosure.

FIG. 11 illustrates an example method 1100 of operation of the implementation of the LED system 100 illustrated in FIGS. 1 and 10 in accordance with at least one embodiment of the present disclosure. At block 1102, a PWM cycle starts, as indicated by the received PWM data (FIG. 1). At block 1103, the ADC 1005 converts the voltage $V_{T1}$ at the tail end of the LED string 105 to a corresponding code value $C_{1X}$ when the LED string 105 (e.g., when activated by a PWM pulse). Likewise, at block 1004 the ADC 1006 converts the voltage $V_{T2}$ at the tail end of the LED string 106 to a corresponding code value $C_{2X}$ when the LED string 106 is activated by a PWM pulse, and at block 1005 the ADC 1007 converts the voltage $V_{Tn}$ at the tail end of the LED string 107 to a corresponding code value $C_{nX}$ when the LED string 107 is activated by a PWM pulse.

At block 1106, the digital minimum detect module 1004 determines the minimum code value $C_{min_min}$ of the plurality of code values generated during the PWM cycle thus far, or, in an alternate embodiment, at the end of the PWM cycle from the code values generated over the entire PWM cycle. At block 1108, the data/timing control module 128 determines whether the end of the PWM cycle has been reached. If not, the process of blocks 1103, 1104, 1105, 1106, and 1108 is repeated to generate another set of code values from the tail voltages of the active LED strings and update the minimum code value $C_{min_min}$ as necessary. Otherwise, if the PWM cycle has ended, at block 1110, the code processing module 120 converts the code value $C_{min_min}$ to an updated code value $C_{reg}$ based on a comparison of the code value $C_{min_min}$ to the predetermined code value $C_{thresh}$. The control DAC 122 converts the updated code value $C_{reg}$ to the corresponding voltage $V_{reg}$, which is used by the error amplifier 124 along with the voltage $V_{fb}$ to adjust the output voltage $V_{OUT}$ as described above.

Figure 12:
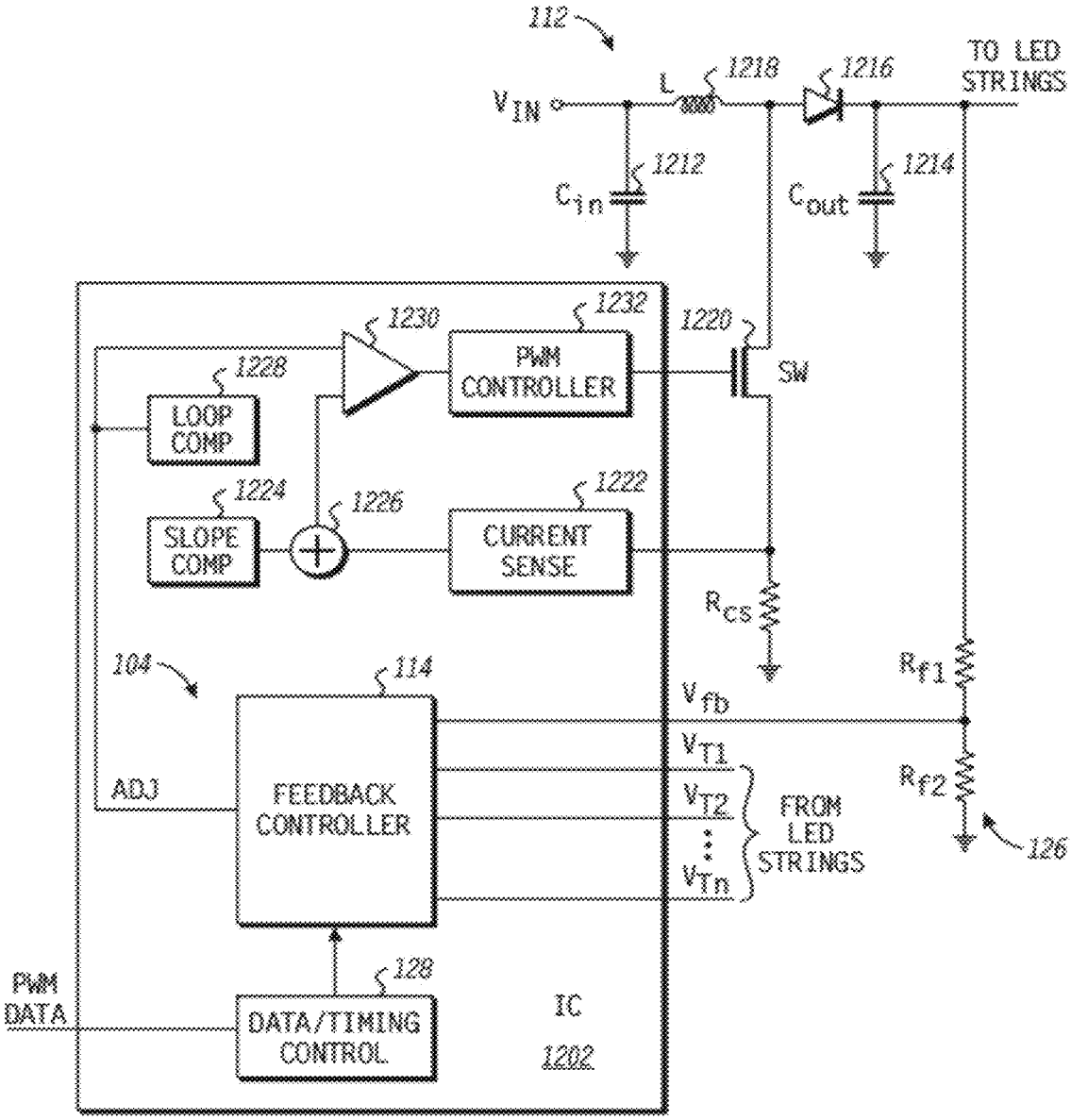
FIG. 12 is a diagram illustrating an integrated circuit (IC)-based implementation of the LED system of FIG. 1 in accordance with at least one embodiment of the present disclosure.

FIG. 12 illustrates an IC-based implementation of the LED system 100 of FIG. 1 as well as an example implementation of the voltage source 112 in accordance with at least one embodiment of the present disclosure. In the depicted example, the LED driver 104 is implemented as an integrated circuit (IC) 1202 having the data/timing control module 128 and the feedback controller 114. As also illustrated, some or all of the components of the voltage source 112 can be implemented at the IC 1202. In one embodiment, the voltage source 112 can be implemented as a step-up boost converter, a buck-boost converter, and the like. To illustrate, the voltage source 112 can be implemented with an input capacitor 1212, an output capacitor 1214, a diode 1216, an inductor 1218, a switch 1220, a current sense block 1222, a slope compensator 1224, an adder 1226, a loop compensator 1228, a comparator 1230, and a PWM controller 1232 connected and configured as illustrated in FIG. 12.

Figure 13:
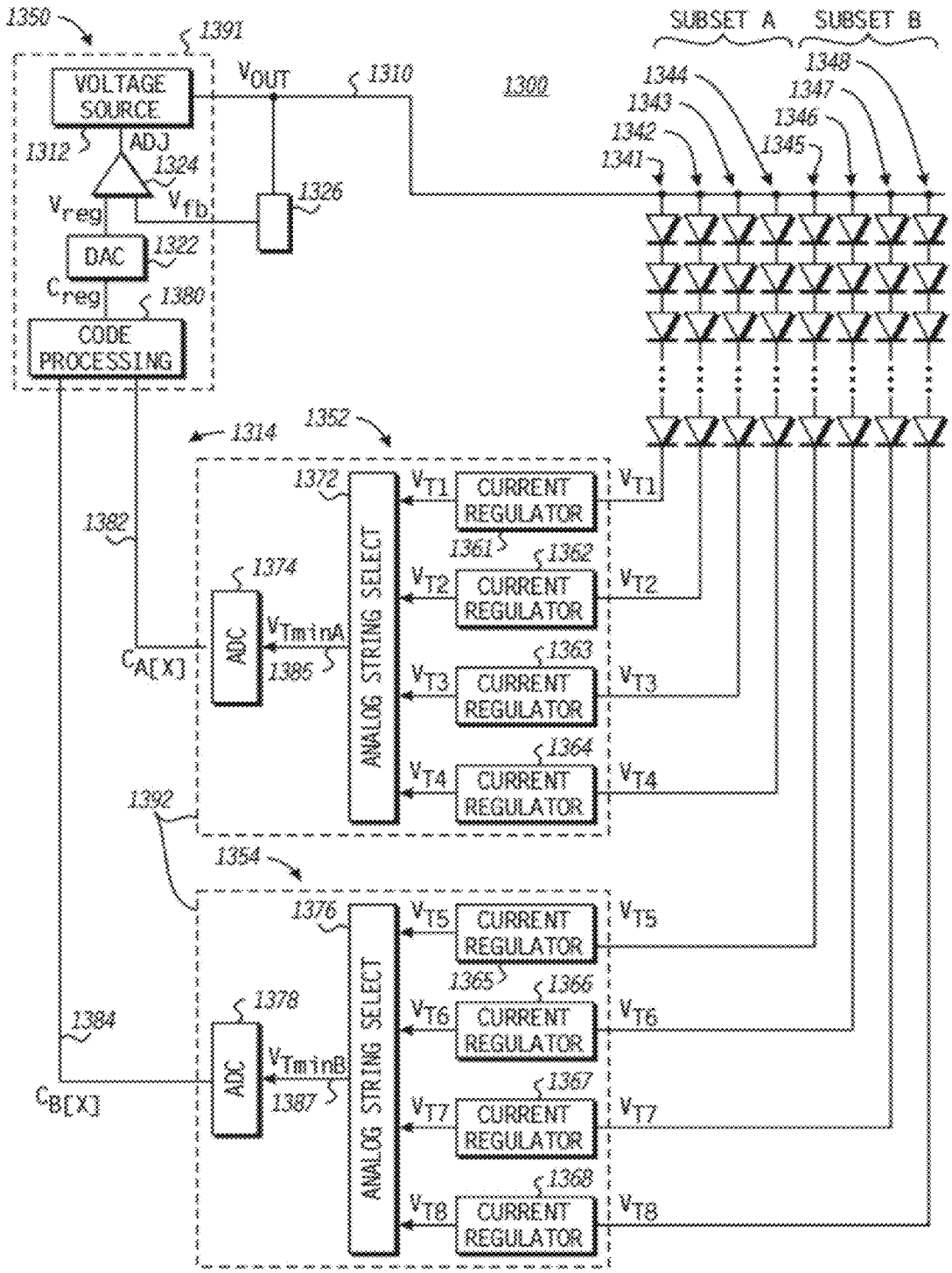
FIG. 13 is a diagram illustrating a segmented implementation of the feedback controller of the LED system of FIG. 1 in accordance with at least one embodiment of the present disclosure.
Figure 14:
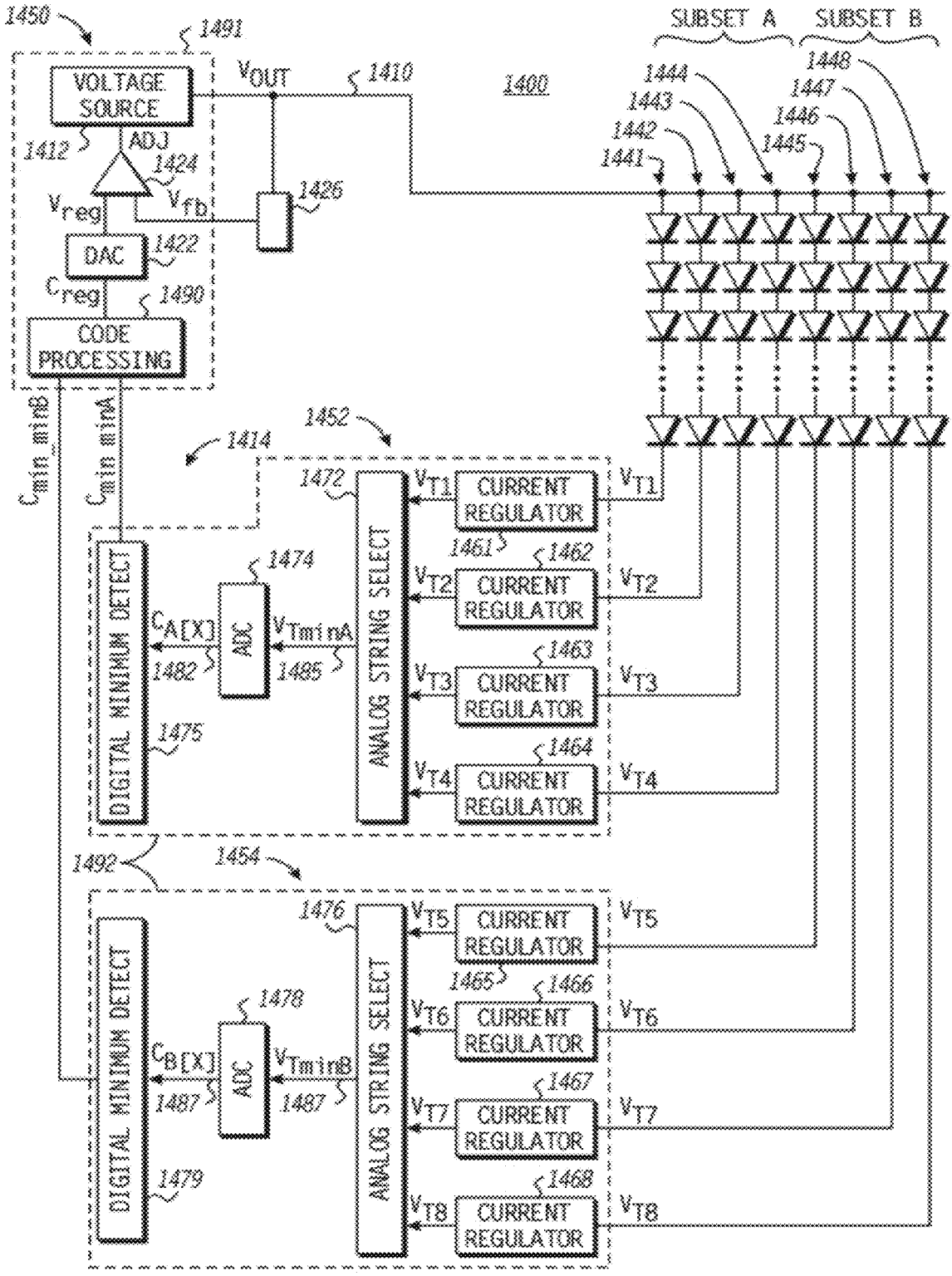
FIG. 14 is a diagram illustrating another segmented implementation of the feedback controller of the LED system of FIG. 1 in accordance with at least one embodiment of the present disclosure.
Figure 15:
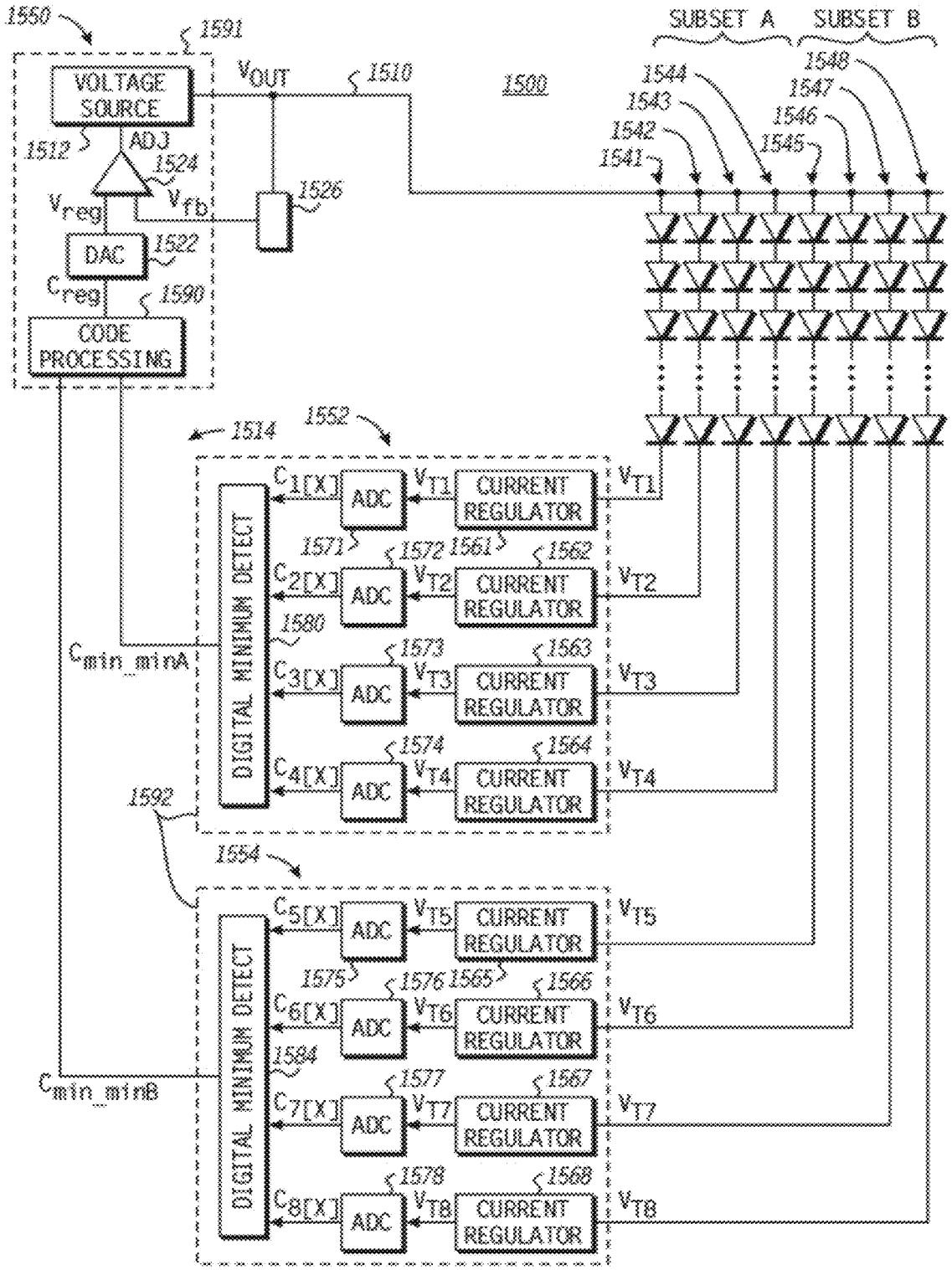
FIG. 15 is a diagram illustrating yet another segmented implementation of the feedback controller of the LED system of FIG. 1 in accordance with at least one embodiment of the present disclosure.

FIGS. 13-15 illustrate various segmented implementations of the feedback controller 114 so as to permit a LED system to readily adapt to any number of LED strings. Further, as described below, the feedback controller 114 can be segmented such that the various segments each can be implemented in separate IC packages so as to permit expansion of the LED system by implementation of additional IC packages. For ease of illustration, the segmented implementations of FIGS. 13-15 are described in an example context whereby the LED strings are separated into two subsets. However, the techniques described below can be implemented for any number of subsets using the guidelines provided herein.

FIG. 13 illustrates an example segmentation of a feedback controller 1314 (corresponding to the feedback controller 114 of FIG. 1) of a LED driver of a LED system 1300 whereby a code value sequence is separately determined for each subset of LED strings and then the overall minimum code value for the plurality of LED strings is determined from the code value sequences of the subsets. The LED system 1300 includes a voltage source 1312 configured to drive an output voltage $V_{OUT}$ to a plurality of LED strings 1341-1348 via a bus 1310. In the illustrated example, the LED strings 1341-1348 are segmented into two subsets: subset A (LED strings 1341-1344) and subset B (LED strings 1345-1348). The voltage source 1312 is controlled via a signal ADJ generated by the feedback controller 1314.

The feedback controller 1314 includes an output to provide the signal ADJ, an input to receive a feedback voltage $V_{fb}$ via a voltage divider 1326 and a plurality of tail inputs adapted to be coupled to the tail ends of the LED strings 1341-1348. In the depicted example, the feedback controller 1314 is segmented into a control segment 1350 and two subset segments 1352 and 1354 corresponding to subsets A and B, respectively. The subset segment 1352 includes current regulators 1361-1364 to regulate the currents through the LED strings 1341-1344, respectively, based on received PWM data (not shown), an analog string select module 1372, and an ADC 1374. The subset segment 1354 is similarly configured and includes current regulators 1365-1368 to regulate the currents through the LED strings 1345-1348, respectively, based on the received PWM data, an analog string select module 1376, and an ADC 1378. The control segment 1350 includes a group code processing module 1380, a control DAC 1322 (corresponding to the control DAC 122, FIG. 1), and an error amplifier 1324 (corresponding to the error amplifier 124). The control segment 1350 further can include a portion or the entirety of the voltage source 1312, as similarly described above with respect to FIG. 12.

In operation, the subset segments 1352 and 1354 are configured to generate respective code value sequences 1382 and 1384 over a specified duration (e.g., a clock cycle, a PWM cycle, an image frame, etc). The group code processing module 1380 receives the code value sequences 1382 and 1384 and determines the overall minimum code value $C_{min_min}$ from the code value sequences 1382 and 1384 for the specified duration. The group code processing module 1380 then generates the code value $C_{reg}$ based on the code value $C_{min_min}$ and provides the code value $C_{reg}$ to the control DAC 1322 for generation of a corresponding voltage $V_{reg}$ as described above. The error amplifier 1324 then compares the voltage $V_{reg}$ with the voltage $V_{fb}$ and configures the signal ADJ based on this relationship so as to control the output voltage $V_{OUT}$ for the following duration.

To this end, the analog string select module 1372 of the subset segment 1352 continuously selects the minimum tail voltage $V_{TminA}$ from the tail voltages $V_{T1}$, $V_{T2}$, $V_{T3}$, and $V_{T4}$ of the LED strings 1341-1344, respectively, and provides this minimum tail voltage $V_{TminA}$ as a signal 1385 to the ADC 1374 as similarly described above with respect to the analog string select modules 402 of FIGS. 4-7. The ADC 1374 then samples the signal 1385 at corresponding points of time over the specified duration based on a clock signal (not shown) and generates a corresponding code value $C_A[x]$ for the code value sequence 1382 from each sampled voltage of the signal 1385 as it is sampled at point x. Likewise, the analog string select module 1376 of the subset segment 1354 continuously selects the minimum tail voltage $V_{TminB}$ from the tail voltages $V_{T5}$, $V_{T6}$, $V_{T7}$, and $V_{T8}$ of the LED strings 1345-1348, respectively, and provides this minimum tail voltage $V_{TminB}$ as a signal 1387 to the ADC 1378. The ADC 1378 then samples the signal 1387 at various points of time over the specified duration based on a clock signal (not shown) and generates a corresponding code value $C_B[x]$ for the code value sequence 1384 from each sampled voltage of the signal 1387 as it is sampled at point x.

The illustrated segmentation of the feedback controller 1314 facilitates implementation of the feedback controller 1314 over a number of IC packages in a manner that permits the feedback controller 1314 to be expanded to accommodate a wide number of LED strings by adding additional IC packages. To illustrate, in one embodiment, the LED system 1300 includes an IC package 1391 in which the control segment 1350 is implemented and two IC packages 1392 in which the subset segments 1352 and 1354 are respectively implemented. In this manner, the feedback controller 1314 can be expanded to include additional subset of LED strings by adding another IC package 1392 to regulate the currents through the LED strings of the additional subset and to generate a code value sequence for use by the group code processing module 1380 in determining the overall minimum code value of the LED strings driven by the voltage source 1312. Thus, assuming the group code processing module 1380 can process up to X code value sequences and each IC package 1392 is capable of supporting up to Y LED strings, the feedback controller 1314 can support up to X*Y LED strings (assuming the voltage source 1312 can provide sufficient power).

FIG. 14 illustrates an example segmentation of a feedback controller 1414 (corresponding to the feedback controller 114 of FIG. 1) of a LED system 1400 whereby a minimum code value is separately determined for each subset of LED strings for a predetermined duration and then the overall minimum code value for the plurality of LED strings for the predetermined duration is determined from the minimum code values of the subsets. The example implementation of FIG. 14 therefore differs from the example implementation of FIG. 13 in that the minimum code value for each segment is separately determined and then transmitted to a group code processing module for use in determining the overall minimum code value. Accordingly, the implementation of FIG. 14 can result in lower bandwidth requirements between the control segment and the subset segments.

The LED system 1400 of FIG. 14 includes a voltage source 1412 configured to drive an output voltage $V_{OUT}$ to a plurality of LED strings 1441-1448 via a bus 1410. In the illustrated example, the LED strings 1441-1448 are segmented into two separate subsets: subset A (LED strings 1441-1444) and subset B (LED strings 1445-1448 ). The voltage source 1412 is controlled via a signal ADJ generated by the feedback controller 1414.

The feedback controller 1414 includes an output to provide the signal ADJ, an input to receive a feedback voltage $V_{fb}$ via a voltage divider 1426, and a plurality of tail inputs coupled to the tail ends of the LED strings 1441-1448. The feedback controller 1414 is segmented into a control segment 1450 and two subset segments 1452 and 1454 corresponding to subsets A and B, respectively. The subset segment 1452 includes current regulators 1461-1464 to regulate the currents through the LED strings 1441-1444, respectively, based on received PWM data (not shown), an analog string select module 1472, an ADC 1474, and a digital minimum detect module 1475. The subset segment 1454 is similarly configured and includes current regulators 1465-1468 to regulate the currents through the LED strings 1445-1448, respectively, based on the received PWM data, an analog string select module 1476, an ADC 1478, and a digital minimum detect module 1479. The control segment 1450 includes a group code processing module 1490, a control DAC 1422 (corresponding to the control DAC 122, FIG. 1), and an error amplifier 1424 (corresponding to the error amplifier 124 ). The control segment 1450 further can include a portion or the entirety of the voltage source 1412, as similarly described above with respect to FIG. 12.

In operation, the subset segment 1452 is configured to generate a minimum code value $C_{min_minA}$ representative of the minimum tail voltage of the tail voltages $V_{T1}$-$V_{T4}$ of the LED strings 1441-1444, respectively, over a specified duration (e.g., a clock cycle, a PWM cycle, an image frame, etc). Likewise, the subset segment 1454 is configured to generate a minimum code value $C_{min_minB}$ representative of the minimum tail voltage of the tail voltages $V_{T5}$-$V_{T8}$ of the LED strings 1441-1444, respectively, over the specified duration. The group code processing module 1490 determines the overall minimum code value $C_{min_min}$ for the specified duration as the lower code value of the minimum code values $C_{min_minA}$ and $C_{min_minB}$. The group code processing module 1490 then generates the code value $C_{reg}$ based on the code value $C_{min_min}$ and provides the code value $C_{reg}$ to the control DAC 1422 for generation of a corresponding voltage $V_{reg}$ as described above. The error amplifier 1424 then compares the voltage $V_{reg}$ with the voltage $V_{fb}$ and configures the signal ADJ based on this relationship so as to control the output voltage $V_{OUT}$ for the following duration.

In order to determine the minimum code value $C_{min_minA}$ of the subset A of LED strings for the specified duration, the analog string select module 1472 of the subset segment 1452 continuously selects the minimum tail voltage $V_{TminA}$ from the tail voltages $V_{T1}$, $V_{T2}$, $V_{T3}$, and $V_{T4}$ of the LED strings 1441-1444, respectively, and provides this minimum tail voltage $V_{TminA}$ as a signal 1485 to the ADC 1474 as similarly described above with respect to FIG. 13. The ADC 1474 then samples the signal 1485 at corresponding points of time over the specified duration based on a clock signal (not shown) and generates a corresponding code value $C_A[x]$ for a code value sequence 1482 from each sampled voltage of the signal 1485 as it is sampled at point x. The digital minimum detect module 1475 determines the lowest code value from the code value sequence 1482 generated by the ADC 1474 for the specified duration as the minimum code value $C_{min_minA}$ for the subset A for the specified duration.

Likewise, the analog string select module 1476 of the subset segment 1454 continuously selects the minimum tail voltage $V_{TminB}$ from the tail voltages $V_{T5}$, $V_{T6}$, $V_{T7}$, and $V_{T8}$ of the LED strings 1445-1448, respectively, and provides this minimum tail voltage $V_{TminB}$ as a signal 1487 to the ADC 1478. The ADC 1478 then samples the signal 1487 at various points of time over the specified duration based on a clock signal (not shown) and generates a corresponding code value $C_B[x]$ for the code value sequence 1484 from each sampled voltage of the signal 1487 as it is sampled at point x. The digital minimum detect module 1479 determines the lowest code value from the code value sequence 1484 generated by the ADC 1478 for the specified duration as the minimum code value $C_{min_minB}$ for the subset B for the specified duration.

The illustrated segmentation of the feedback controller 1414 permits the feedback controller 1414 to be implemented over a number of IC packages in a manner that permits the feedback controller 1414 to be expanded to accommodate a wide number of LED strings by adding additional IC packages. To illustrate, in one embodiment, the LED system 1400 includes an IC package 1491 in which the control segment 1450 is implemented and two IC packages 1492 in which the subset segments 1452 and 1454 are respectively implemented. In this manner, the feedback controller 1414 can be expanded to include additional subset of LED strings by adding another IC package 1492 to regulate the currents through the LED strings of the additional subset and to generate minimum code value for the additional subset for use by the group code processing module 1490 in determining the overall minimum code value of the LED strings driven by the voltage source 1412. Thus, assuming the group code processing module 1480 can support up to X IC packages 1492 and each IC package 1492 is capable of supporting up to Y LED strings, the feedback controller 1414 can support up to X*Y LED strings (assuming the voltage source 1412 can provide sufficient power).

FIG. 15 illustrates an example segmentation of a feedback controller 1514 (corresponding to the feedback controller 114 of FIG. 1) of a LED system 1500 whereby a code value sequence is separately determined for each subset of LED strings for a predetermined duration and then the overall minimum code value for the plurality of LED strings for the predetermined duration is determined from the minimum code values of the subsets. The LED system 1500 includes a voltage source 1512 configured to drive an output voltage $V_{OUT}$ to a plurality of LED strings 1541-1548 via a bus 1510. In the illustrated example, the LED strings 1541-1548 are segmented into two separate subsets: subset A (LED strings 1541-1544) and subset B (LED strings 1545-1548). The voltage source 1512 is controlled via a signal ADJ generated by the feedback controller 1514.

In the depicted embodiment, the feedback controller 1514 is a variation of the feedback controller 1514 such that the feedback controller 1514 is segmented into the control segment 1550 and two subset segments 1552 and 1554 corresponding to subsets A and B, respectively. The subset segment 1552 includes current regulators 1561-1564 to regulate the currents through the LED strings 1541-1544, respectively, based on received PWM data (not shown), ADCs 1571-1574, and a digital minimum detect module 1580. The subset segment 1554 is similarly configured and includes current regulators 1565-1568 to regulate the currents through the LED strings 1545-1548, respectively, based on the received PWM data, ADCs 1575-1578, and a digital minimum detect module 1584.

In operation, the subset segment 1552 is configured to generate a minimum code value $C_{min_minA}$ representative of the minimum tail voltage of the tail voltages $V_{T1}$-$V_{T4}$ of the LED strings 1541-1544, respectively, over a specified duration (e.g., a clock cycle, a PWM cycle, an image frame, etc). Likewise, the subset segment 1554 is configured to generate a minimum code value $C_{min_minB}$ representative of the minimum tail voltage of the tail voltages $V_{T5}$-$V_{T8}$ of the LED strings 1541-1544, respectively, over the specified duration. The group code processing module 1590 determines the overall minimum code value $C_{min_min}$ for the specified duration as the lower code value of the minimum code values $C_{min_minA}$ and $C_{min_minB}$. The group code processing module 1590 then generates the code value $C_{reg}$ based on the code value $C_{min_min}$ and provides the code value $C_{reg}$ to the control DAC 1522 for generation of a corresponding voltage $V_{reg}$ as described above. The error amplifier 1524 then compares the voltage $V_{reg}$ with the voltage $V_{fb}$ (generated via, e.g., a voltage divider 1526) and configures the signal ADJ based on this relationship so as to control the output voltage $V_{OUT}$ for the following duration.

In order to determine the minimum code value $C_{min_minA}$ of the subset A of LED strings for the specified duration, the ADCs 1571-1574 of the subset segment 1552 each samples the tail voltages of the corresponding LED strings 1541-1544 at corresponding points of time over the specified duration to generate a corresponding set of code value sequences (identified as code value sequences $C_1[x]$, $C_2[x]$, $C_3[x]$, and $C_4[x]$, respectively). The digital minimum detect module 1580 determines the lowest code value from the code value sequences generated by the ADCs 1571-1574 for the specified duration and provides this lowest code value the code value $C_{min_minA}$. The subset segment 1554 operates in a similar manner to determine the minimum code value $C_{min_minB}$ from code value sequences $C_5[x]$, $C_6[x]$, $C_7[x]$, and $C_8[x]$ generated over the specified duration from the tail voltages $V_{T5}$-$V_{T8}$ of the LED strings 1545-1548, respectively.

The illustrated segmentation of the feedback controller 1514 permits the feedback controller 1514 to be implemented over a number of IC packages in a manner that permits the feedback controller 1514 to be expanded to accommodate a wide number of LED strings by adding additional IC packages. To illustrate, in one embodiment, the LED system 1500 includes an IC package 1591 in which the control segment 1550 is implemented and two IC packages 1592 in which the subset segments 1552 and 1554 are respectively implemented. In this manner, the feedback controller 1514 can be expanded to include additional subset of LED strings by adding another IC package 1592 to regulate the currents through the LED strings of the additional subset and to generate a code value sequence for the additional subset for use by the group code processing module 1590 in determining the overall minimum code value of the LED strings driven by the voltage source 1512. Thus, assuming the group code processing module 1590 can support up to X IC packages 1592 and each IC package 1592 is capable of supporting up to Y LED strings, the feedback controller 1514 can support up to X*Y LED strings (assuming the voltage source 1512 can provide sufficient power).

The term "another", as used herein, is defined as at least a second or more. The terms "including", "having", or any variation thereof, as used herein, are defined as comprising. The term "coupled", as used herein with reference to electro-optical technology, is defined as connected, although not necessarily directly, and not necessarily mechanically.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

providing, for a first duration, a first voltage to a head end of each light emitting diode (LED) string of a plurality of light emitting diode (LED) strings, each LED string having a corresponding tail voltage in response to the first voltage;

determining a first digital code value representative of a minimum tail voltage of the tail voltages of the plurality of LED strings for the first duration; and providing, for a second duration subsequent to the first duration, a second voltage to the head end of each of the plurality of LED strings, the second voltage based on the first voltage and the first digital code value.

2. The method of claim 1, wherein providing the second voltage comprises:

determining a second digital code value based on the first digital code value;

generating a third voltage based on the first voltage;

generating a fourth voltage based on the second digital code value;

providing the second voltage based on a relationship between the third voltage and the fourth voltage.

3. The method of claim 2, wherein generating the third voltage comprises generating the third voltage from the first voltage via a voltage divider.

4. The method of claim 2, wherein providing the second voltage comprises:

providing as the second voltage a voltage greater than the first voltage in response to the third voltage being less than the fourth voltage; and providing as the second voltage a voltage less than the first voltage in response to the fourth voltage being less than the third voltage.

5. The method of claim 1, wherein the plurality of LED strings comprises a plurality of subsets of LED strings and wherein determining the first digital code value comprises:

for each subset of LED strings:

determining a minimum tail voltage of the subset of LED strings at each corresponding point in time of the first duration; and generating a sequence of digital code values for the subset, each digital code value representative of the corresponding minimum tail voltage of the subset at the corresponding point in time of the first duration; and determining as the first digital code value an overall minimum digital code value of the sequences of digital code values of the subsets of LED strings for the first duration.

6. The method of claim 1, wherein the plurality of LED strings comprises a plurality of subsets of LED strings and wherein determining the first digital code value comprises:

for each subset of LED strings:

determining a minimum tail voltage of the subset of LED strings at each corresponding point in time of the first duration;

generating a sequence of digital code values for the subset, each digital code value representative of the corresponding minimum tail voltage of the subset at the corresponding point in time of the first duration; and determining the minimum digital code value for the subset from the sequence of digital code values for the subset; and determining the first digital code value as an overall minimum digital code value of the minimum digital code values of the subsets of LED strings for the first duration.

7. The method of claim 1, wherein the plurality of LED strings comprises a plurality of subsets of LED strings and wherein determining the first digital code value comprises:

for each subset of LED strings:

for each LED string of the subset, generating a sequence of digital code values for the LED string, each digital code value representative of a tail voltage of the LED string at a corresponding point in time of the first duration;

generating a sequence of digital code values for the subset, each digital code value of the sequence corresponding to a minimum digital code value of the LED strings of the subset at the corresponding point in time of the first duration; and determining a minimum digital code value for the subset from the sequence of digital code values for the subset; and determining the first digital code value as an overall minimum digital code value of the minimum digital code values of the subsets of LED strings for the first duration.

8. The method of claim 1, wherein the plurality of LED strings comprises a plurality of subsets of LED strings and wherein determining the first digital code value comprises:

for each subset of LED strings:

for each LED string of the subset, generating a sequence of digital code values for the LED string, each digital code value representative of a tail voltage of the LED string at a corresponding point in time of the first duration; and generating a sequence of digital code values for the subset, each digital code value of the sequence corresponding to a minimum digital code value of the LED strings of the subset at the corresponding point in time of the first duration; and determining the first digital code value as an overall minimum digital code value of the sequences of digital code values of the plurality of subsets of LED strings for the first duration.

9. A system comprising:

a voltage source configured to provide an adjustable output voltage to a head end of each of a plurality of light emitting diode (LED) strings; and a LED driver comprising:

a plurality of tail inputs, each tail input configured to couple to a tail end of a corresponding one of the plurality of LED strings; and a feedback controller coupled to the plurality of tail inputs and configured to:

determine a first digital code value representative of a minimum tail voltage of tail voltages of the plurality of LED strings for a first duration; and control the voltage source to adjust the adjustable output voltage for a second duration subsequent to the first duration based on a first voltage and the first digital code value.

10. The system of claim 9, wherein the plurality of LED strings comprises a plurality of subsets of LED strings and wherein the feedback controller comprises:

for each subset of LED strings:

an analog string select module configured to generate a signal representing a minimum tail voltage of the subset over the first duration; and an analog-to-digital converter (ADC) configured to generate a sequence of digital code values for the subset based on the signal, each digital code value of the sequence representative of a voltage of the signal at a corresponding point in time of the first duration; and a code processing module configured to determine the first digital code value as an overall minimum code value of the sequences of digital code values for the subsets of LED strings for the first duration.

11. The system of claim 10, further comprising:

a plurality of first integrated circuit (IC) packages, each first IC package comprising the analog string select module and the ADC associated with a corresponding subset of the plurality of subsets of LED strings; and a second IC package comprising the code processing module.

12. The system of claim 9, wherein the plurality of LED strings comprises a plurality of subsets of LED strings and wherein the feedback controller comprises:

for each subset of LED strings:

an analog string select module configured to generate a signal representing the minimum tail voltage of the subset of LED strings over the first duration;

an analog-to-digital converter (ADC) configured to generate a sequence of digital code values for the subset based on the signal, each digital code value of the sequence representative of a voltage of the signal at a corresponding point in time of the first duration; and a digital minimum detect module configured to determine a minimum digital code value of the sequence of digital code values for the first duration; and a group code processing module configured to determine the first digital code value as an overall minimum code value of minimum digital code values determined by the digital minimum detect modules for the first duration.

13. The system of claim 12, further comprising:

a plurality of first integrated circuit (IC) packages, each first IC package comprising the analog string select module, the ADC, and the digital minimum detect module associated with a corresponding subset of LED strings; and a second IC package comprising the group code processing module.

14. The system of claim 9, wherein the plurality of LED strings comprises a plurality of subsets of LED strings and wherein the feedback controller comprises:

for each subset of LED strings:

for each LED string of the subset, an analog-to-digital converter (ADC) configured to generate a first sequence of digital code values over the first duration, each digital code value of the first sequence representing a tail voltage of the LED string at a corresponding point in time of the first duration; and a digital minimum detect module configured to determine a minimum digital code value of the first sequences of digital code values of the LED strings of the subset; and a group code processing module configured to determine the first digital code value as an overall minimum digital code value of the minimum digital code values determined by the digital minimum detect modules for the first duration.

15. The system of claim 14, further comprising:

a plurality of first integrated circuit (IC) packages, each first IC package comprising the ADC and the digital minimum detect module associated with a corresponding subset of LED strings; and a second IC package comprising the group code processing module.

16. The system of claim 9, wherein the plurality of LED strings comprises a plurality of subsets of LED strings and wherein the feedback controller comprises:

for each subset of LED strings:

for each LED string of the subset, an analog-to-digital converter (ADC) configured to generate a first sequence of digital code values over the first duration, each digital code value of the first sequence representing a tail voltage of the LED string at a corresponding point in time of the first duration; and a digital minimum detect module configured to generate a second sequence of digital code values for the subset based on the first sequences of digital code values of the LED strings of the subset, each digital code value of the second sequence comprising the minimum digital code value of the first sequences at the corresponding point in time of the first duration; and a code processing module configured to determine the first digital code value as an overall minimum digital code value of the second sequences of digital code values determined by the digital minimum detect modules for the first duration.

17. The system of claim 16, further comprising:

a plurality of first integrated circuit (IC) packages, each first IC package comprising the ADC and the digital minimum detect module associated with a corresponding subset of LED strings;

a second IC package comprising the code processing module.

18. The system of claim 9, wherein the feedback controller comprises:

a code processing module configured to determine a second digital code value based on the first digital code value;

a digital-to-analog converter (DAC) configured to generate a regulation voltage based on the second code value; and an error amplifier configured to adjust a control signal based on a comparison of the regulation voltage to a feedback voltage representative of the output voltage, wherein the voltage source is configured to adjust the output voltage based on the control signal.

19. The system of claim 18, wherein:

the feedback voltage comprises a voltage-divided representation of the output voltage using a voltage divider having a first resistor and a second resistor; and the code processing module is configured to generate the second code value based on a sum of the first code value and an offset value, the offset value based on a gain of the DAC, a resistance of the first resistor, and a resistance of the second resistor.

20. The system of claim 9, further comprising:

a display comprising the plurality of LED strings.

* * * * *